US006662470B2

(12) United States Patent
Ellis, III

(10) Patent No.: US 6,662,470 B2
(45) **Date of Patent: *Dec. 16, 2003**

(54) SHOES SOLE STRUCTURES

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/974,943

(22) Filed: Oct. 12, 2001

(65) Prior Publication Data

US 2002/0023373 A1 Feb. 28, 2002

Related U.S. Application Data

(62) Division of application No. 09/907,598, filed on Jul. 19, 2001, which is a division of application No. 09/734,905, filed on Dec. 13, 2000, now Pat. No. 6,308,439, which is a continuation of application No. 08/477,954, filed on Jun. 7, 1995, now Pat. No. 6,163,982, which is a continuation-in-part of application No. 08/376,661, filed on Jan. 23, 1995, which is a continuation of application No. 08/127,487, filed on Sep. 28, 1993, now abandoned, which is a continuation of application No. 07/729,886, filed on Jul. 11, 1991, now abandoned, which is a continuation of application No. 07/400,714, filed on Aug. 30, 1989, now abandoned.

(51) Int. Cl.[7] ..... A43B 13/00; A43B 7/14
(52) U.S. Cl. ..... 36/25 R; 36/88
(58) Field of Search ..... 36/25 R, 30 R, 36/32 R, 31, 114, 88, 89, 11, 12, 127, 92, 93, 14, 15, 91, 113, 115, 140, 143, 144

(56) References Cited

U.S. PATENT DOCUMENTS 193,914 A 8/1877 Berry
280,791 A 7/1883 Brooks
288,127 A 11/1883 Shepard (List continued on next page.)

FOREIGN PATENT DOCUMENTS

| | | |
|---|---|---|
| AT | 200963 | 5/1958 |
| CA | 1 138 194 | 12/1982 |
| CA | 1 176 458 | 10/1984 |

(List continued on next page.)

OTHER PUBLICATIONS

Description of adidas badninton shoe pre–1989(?), 1 page.
The Reebok Lineup, Fall 1987, 2 pages.
Cavanagh et al., "Biological Aspects of Modeling Shoe/Foot Interaction During Running," *Sport Shoes and Playing Surfaces: Biomechanical Proper ties*, Champaign, IL, © 1984, pp. 24–25, 32–35, and 46–47.
Blechschmidt, "The Structure of the Calcaneal Padding," *Foot & Ankle*, © 1982, Official Journal of the American Orthopaedic Foot Society, Inc., pp. 260–283.

(List continued on next page.)

*Primary Examiner*—M D Patterson
(74) *Attorney, Agent, or Firm*—Knoble & Yoshida

(57) ABSTRACT

A shoe sole particularly for athletic footwear for supporting the foot of an intended wearer having multiple rounded portions formed by midsole component as viewed in a frontal plane of the sole when the shoe sole is upright and in an unloaded condition. The rounded portions approximate the structure of and support provided by features of the human foot. The rounded portions are located proximate to important structural support areas of an intended wearer's foot on either or both sides of the shoe sole or the middle portion of the shoe sole, or at various combinations of these locations. The midsole component also includes an indentation in the sole midtarsal portion, as viewed in a sagittal plane, and midsole component extends into a sidemost section of the sole and above a lowermost point of the midsole component, as viewed in a frontal plane cross-section when the shoe sole is upright and in an unloaded condition.

49 Claims, 11 Drawing Sheets

U.S. PATENT DOCUMENTS 500,385 A 6/1893 Hall
532,429 A 1/1895 Rogers
584,373 A 6/1897 Kuhn
1,283,335 A 10/1918 Shillcock
1,289,106 A 12/1918 Bullock
D55,115 S 5/1920 Barney
1,458,446 A 6/1923 Shaeffer
1,622,860 A 3/1927 Cutler
1,639,381 A 8/1927 Manelas
1,701,260 A 2/1929 Fischer
1,735,986 A 11/1929 Wray
1,853,034 A 4/1932 Bradley
1,870,751 A 8/1932 Reach
2,120,987 A 6/1938 Murray
2,124,986 A 7/1938 Pipes
2,147,197 A 2/1939 Glidden
2,155,166 A 4/1939 Kraft
2,162,912 A 6/1939 Craver
2,170,652 A 8/1939 Brennan
2,179,942 A 11/1939 Lyne
D119,894 S 4/1940 Sherman
2,201,300 A 5/1940 Prue
2,206,860 A 7/1940 Sperry
D122,313 S 8/1940 Sannar
D128,817 S 8/1941 Esterson
2,251,468 A 8/1941 Smith
2,328,242 A 8/1943 Witherill
2,328,424 A 8/1943 Witherill
2,345,831 A 4/1944 Pierson
2,433,329 A 12/1947 Adler et al.
2,434,770 A 1/1948 Lutey
2,470,200 A 5/1949 Wallach
2,627,676 A 2/1953 Hack
2,718,715 A 9/1955 Spilman
2,814,133 A 11/1957 Herbst
3,005,272 A 10/1961 Shelare et al.
3,100,354 A 8/1963 Lombard et al.
3,110,971 A 11/1963 Chang
3,305,947 A 2/1967 Kalsoy
3,308,560 A 3/1967 Jones
3,416,174 A 12/1968 Novitske
3,512,274 A 5/1970 McGrath
3,535,799 A 10/1970 Onitsuka
3,806,974 A 4/1974 Di Paolo
3,824,716 A 7/1974 Di Paolo
3,863,366 A 2/1975 Auberry et al.
3,958,291 A 5/1976 Spier
3,964,181 A 6/1976 Holcombe, Jr.
3,997,984 A 12/1976 Hayward
4,003,145 A 1/1977 Liebscher et al.
4,030,213 A 6/1977 Daswick
4,043,058 A 8/1977 Hollister et al. ..... 36/102
4,068,395 A 1/1978 Senter
4,083,125 A 4/1978 Benseler et al.
4,096,649 A 6/1978 Saurwein
4,098,011 A 7/1978 Bowerman et al.
4,128,950 A 12/1978 Bowerman et al. ..... 36/30
4,128,951 A 12/1978 Tansill
4,141,158 A 2/1979 Benseler et al.
4,145,785 A 3/1979 Lacey
4,149,324 A 4/1979 Lesser et al.
4,161,828 A 7/1979 Benseler et al.
4,161,829 A 7/1979 Wayser
4,170,078 A 10/1979 Moss
4,183,156 A 1/1980 Rudy
4,194,310 A 3/1980 Bowerman
D256,180 S 8/1980 Turner
D256,400 S 8/1980 Famolare, Jr.
4,217,705 A 8/1980 Donzis
4,219,945 A 9/1980 Rudy
4,223,457 A 9/1980 Borgeas
4,227,320 A 10/1980 Borgeas
4,235,026 A 11/1980 Plagenhoef
4,237,627 A 12/1980 Turner
4,240,214 A 12/1980 Sigle et al.
4,241,523 A 12/1980 Daswick
4,245,406 A 1/1981 Landay et al.
4,250,638 A 2/1981 Linnemann
4,258,480 A 3/1981 Famolare, Jr.
4,259,792 A 4/1981 Halberstadt
4,262,433 A 4/1981 Hagg et al.
4,263,728 A 4/1981 Frecentese
4,266,349 A 5/1981 Schmohl
4,268,980 A 5/1981 Gudas
4,271,606 A 6/1981 Rudy ..... 36/28
4,272,858 A 6/1981 Hlustik
4,274,211 A 6/1981 Funck
4,297,797 A 11/1981 Meyers
4,302,892 A 12/1981 Adamik
4,305,212 A 12/1981 Coomer
4,308,671 A 1/1982 Bretschneider
4,309,832 A 1/1982 Hunt
4,314,413 A 2/1982 Dassler ..... 36/129
4,316,332 A 2/1982 Giese et al.
4,316,335 A 2/1982 Giese et al.
4,319,412 A 3/1982 Muller et al.
D264,017 S 4/1982 Turner
4,322,895 A 4/1982 Hockerson
D265,019 S 6/1982 Vermonet
4,335,529 A 6/1982 Badalamenti
4,340,626 A 7/1982 Rudy
4,342,161 A 8/1982 Schmohl
4,348,821 A 9/1982 Daswick
4,354,319 A 10/1982 Block et al.
4,361,971 A 12/1982 Bowerman
4,366,634 A 1/1983 Giese et al.
4,370,817 A 2/1983 Ratanangsu
4,372,059 A 2/1983 Ambrose
4,398,357 A 8/1983 Batra
4,399,620 A 8/1983 Funck
D272,294 S 1/1984 Watanabe
4,449,306 A 5/1984 Cavanagh
4,451,994 A 6/1984 Fowler
4,454,662 A 6/1984 Stubblefield
4,455,765 A 6/1984 Sjösward
4,455,767 A 6/1984 Bergmans
4,468,870 A 9/1984 Sternberg
4,484,397 A 11/1984 Curley, Jr.
4,494,321 A 1/1985 Lawlor
4,505,055 A 3/1985 Bergmans
4,506,462 A 3/1985 Cavanagh
4,521,979 A 6/1985 Blaser
4,527,345 A 7/1985 Lopez Lopez
D280,568 S 9/1985 Stubblefield
4,542,598 A 9/1985 Misevich et al.
4,546,559 A 10/1985 Dassler
4,557,059 A 12/1985 Misevich et al.
4,559,723 A 12/1985 Hamy et al.
4,559,724 A 12/1985 Norton
4,561,195 A 12/1985 Onoda et al.
4,577,417 A 3/1986 Cole
4,578,882 A 4/1986 Talarico, II
4,580,359 A 4/1986 Kurrash et al.
4,624,061 A 11/1986 Wezel et al.
4,624,062 A 11/1986 Autry
4,641,438 A 2/1987 Laird et al.
4,642,917 A 2/1987 Ungar
4,651,445 A 3/1987 Hannibal
D289,341 S 4/1987 Turner
4,670,995 A 6/1987 Huang
4,676,010 A 6/1987 Cheskin

| | | | | |
|---|---|---|---|---|
| 4,694,591 | A | 9/1987 | Banich et al. | |
| 4,697,361 | A | 10/1987 | Ganter et al. | |
| D293,275 | S | 12/1987 | Bua | |
| 4,715,133 | A | 12/1987 | Hartjes et al. | |
| 4,724,622 | A | 2/1988 | Mills | |
| D294,425 | S | 3/1988 | Le | |
| 4,727,660 | A | 3/1988 | Bernhard | |
| 4,730,402 | A | 3/1988 | Norton et al. | |
| 4,731,939 | A | 3/1988 | Parracho et al. | |
| 4,747,220 | A | 5/1988 | Autry et al. | |
| D296,149 | S | 6/1988 | Diaz | |
| D296,152 | S | 6/1988 | Selbiger | |
| 4,748,753 | A | 6/1988 | Ju | |
| 4,754,561 | A | 7/1988 | Dufour | |
| 4,756,098 | A | 7/1988 | Boggia | |
| 4,757,620 | A | 7/1988 | Tiitola | |
| 4,759,136 | A | 7/1988 | Stewart et al. | |
| 4,768,295 | A | 9/1988 | Ito | |
| 4,769,926 | A | 9/1988 | Meyers | 36/43 |
| D298,684 | S | 11/1988 | Pitchford | |
| 4,785,557 | A | 11/1988 | Kelley et al. | |
| 4,817,304 | A | 4/1989 | Parker et al. | |
| 4,827,631 | A | 5/1989 | Thornton | |
| 4,833,795 | A | 5/1989 | Diaz | |
| 4,837,949 | A | 6/1989 | Dufour | |
| D302,900 | S | 8/1989 | Kolman et al. | |
| 4,854,057 | A | 8/1989 | Misevich et al. | |
| 4,858,340 | A | 8/1989 | Pasternak | |
| 4,866,861 | A | 9/1989 | Noone | |
| 4,876,807 | A | 10/1989 | Tiitola et al. | |
| 4,890,398 | A | 1/1990 | Thomasson | |
| 4,894,933 | A | 1/1990 | Tonkel et al. | 36/28 |
| 4,897,936 | A | 2/1990 | Fuerst | 36/30 |
| 4,906,502 | A | 3/1990 | Rudy | |
| 4,922,631 | A | 5/1990 | Anderie | |
| 4,934,070 | A | 6/1990 | Mauger | |
| 4,934,073 | A | 6/1990 | Robinson | |
| D310,131 | S | 8/1990 | Hase | |
| D310,132 | S | 8/1990 | Hase | |
| 4,947,560 | A | 8/1990 | Fuerst et al. | |
| 4,949,476 | A | 8/1990 | Anderie | |
| D310,906 | S | 10/1990 | Hase | |
| 4,982,737 | A | 1/1991 | Guttmann | |
| 4,989,349 | A | 2/1991 | Ellis, III | |
| D315,634 | S | 3/1991 | Yung-Mao | |
| 5,010,662 | A | 4/1991 | Dabuzhsky et al. | |
| 5,014,449 | A | 5/1991 | Richard et al. | |
| 5,024,007 | A | 6/1991 | DuFour | |
| 5,025,573 | A | 6/1991 | Giese et al. | |
| D320,302 | S | 10/1991 | Kiyosawa | |
| 5,052,130 | A | 10/1991 | Barry et al. | |
| 5,077,916 | A | 1/1992 | Beneteau | |
| 5,079,856 | A | 1/1992 | Truelsen | |
| 5,092,060 | A | 3/1992 | Frachey et al. | |
| D327,164 | S | 6/1992 | Hatfield | |
| D327,165 | S | 6/1992 | Hatfield | |
| 5,131,173 | A | 7/1992 | Anderie | |
| D328,968 | S | 9/1992 | Tinker | |
| D329,528 | S | 9/1992 | Hatfield | |
| D329,739 | S | 9/1992 | Hatfield | |
| D330,972 | S | 11/1992 | Hatfield et al. | |
| D332,344 | S | 1/1993 | Hatfield et al. | |
| D332,692 | S | 1/1993 | Hatfield et al. | |
| 5,191,727 | A | 3/1993 | Barry et al. | 36/107 |
| 5,224,280 | A | 7/1993 | Preman et al. | |
| 5,224,810 | A | 7/1993 | Pitkin | |
| 5,237,758 | A | 8/1993 | Zachman | |
| D347,105 | S | 5/1994 | Johnson | |
| 5,317,819 | A | 6/1994 | Ellis, III | |
| 5,369,896 | A | 12/1994 | Frachey et al. | 36/29 |
| D372,114 | S | 7/1996 | Tunre et al. | |
| 5,543,194 | A | 8/1996 | Rudy | |
| 5,544,429 | A | 8/1996 | Ellis, III | |
| 5,573,805 | A | 11/1996 | Fager et al. | |
| D388,594 | S | 1/1998 | Turner et al. | |
| D409,362 | S | 5/1999 | Turner et al. | |
| D409,826 | S | 5/1999 | Turner et al. | |
| D410,138 | S | 5/1999 | Turner et al. | |
| 5,909,948 | A | 6/1999 | Ellis, III | |
| 6,115,941 | A | 9/2000 | Ellis, III | |
| 6,115,945 | A | 9/2000 | Ellis, III | |
| 6,163,982 | A | 12/2000 | Ellis, III | |
| D444,293 | S | 7/2001 | Turner et al. | |
| D450,916 | S | 11/2001 | Turner et al. | |

FOREIGN PATENT DOCUMENTS

| | | | |
|---|---|---|---|
| DE | B23257 VII/71a | | 5/1956 |
| DE | 1 888 119 | | 12/1963 |
| DE | 1918131 | | 6/1965 |
| DE | 1918132 | | 6/1965 |
| DE | 1 287 477 | | 1/1969 |
| DE | 1 290 844 | | 3/1969 |
| DE | 2036062 | | 7/1970 |
| DE | 1948620 | | 5/1971 |
| DE | 1685293 | | 7/1971 |
| DE | 1 685 260 | | 10/1971 |
| DE | 2045430 | | 3/1972 |
| DE | 2522127 | | 11/1976 |
| DE | 2525613 | | 12/1976 |
| DE | 2602310 | | 7/1977 |
| DE | 2613312 | | 10/1977 |
| DE | 27 06 645 | | 8/1978 |
| DE | 2654116 | | 1/1979 |
| DE | 27 37 765 | | 3/1979 |
| DE | 28 05 426 | | 8/1979 |
| DE | 3021936 | | 4/1981 |
| DE | 30 24 587 | A1 | 1/1982 |
| DE | 8219616.8 | | 9/1982 |
| DE | 3113295 | | 10/1982 |
| DE | 32 45 182 | | 5/1983 |
| DE | 33 17 462 | | 10/1983 |
| DE | 8431831 | | 12/1984 |
| DE | 8381831.7 | | 12/1984 |
| DE | 3347343 | | 7/1985 |
| DE | 8530136.1 | | 2/1988 |
| DE | 36 29 245 | | 3/1988 |
| EP | 0 048 965 | | 4/1982 |
| EP | 0 083 449 | A1 | 7/1983 |
| EP | 0 130 816 | | 1/1985 |
| EP | 0 185 781 | | 7/1986 |
| EP | 0207063 | | 10/1986 |
| EP | 0 206 511 | | 12/1986 |
| EP | 0 213 257 | | 3/1987 |
| EP | 0 215 974 | | 4/1987 |
| EP | 0 238 995 | | 9/1987 |
| EP | 0 260 777 | | 3/1988 |
| EP | 0 301 331 | A2 | 2/1989 |
| EP | 0 329 391 | | 8/1989 |
| EP | 0 410 087 | A2 | 1/1991 |
| FR | 602.501 | | 3/1926 |
| FR | 925.961 | | 9/1947 |
| FR | 1.004.472 | | 3/1952 |
| FR | 1245672 | | 10/1960 |
| FR | 1.323.455 | | 2/1963 |
| FR | 2 006 270 | | 11/1971 |
| FR | 2 261 721 | | 9/1975 |
| FR | 2 511 850 | | 3/1983 |
| FR | 2 622 411 | | 5/1989 |
| GB | 16143 | | 2/1892 |
| GB | 9591 | | 11/1913 |
| GB | 764956 | | 1/1957 |
| GB | 807305 | | 1/1959 |

| | | |
|---|---|---|
| GB | 1504615 | 3/1978 |
| GB | 2 023 405 | 1/1980 |
| GB | 2 039 717 A | 8/1980 |
| GB | 2076633 | 12/1981 |
| GB | 2133668 | 8/1984 |
| GB | 2 136 670 | 9/1984 |
| JP | 39-15597 | 8/1964 |
| JP | 45-5154 | 3/1970 |
| JP | 50-71132 | 11/1975 |
| JP | 57-139333 | 8/1982 |
| JP | 59-23525 | 7/1984 |
| JP | 61-55810 | 4/1986 |
| JP | 1129505 | 6/1986 |
| JP | 61-167810 | 10/1986 |
| JP | 1-95803 | 8/1989 |
| JP | 2136505 | 5/1990 |
| JP | 22779103 | 11/1990 |
| JP | 3-85102 | 4/1991 |
| JP | 3086101 | 4/1991 |
| JP | 4-279102 | 10/1992 |
| JP | 5-123204 | 5/1993 |
| NZ | 189890 | 9/1981 |
| WO | WO 87/07480 | 12/1987 |
| WO | WO8707481 | 12/1987 |
| WO | WO 88/08263 | 11/1988 |
| WO | WO 89/06500 | 7/1989 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 93/13928 | 7/1993 |
| WO | WO 94/03080 | 2/1994 |
| WO | WO 97/00029 | 1/1997 |
| WO | WO 00/64293 | 11/2000 |

OTHER PUBLICATIONS

Cavanagh, *The Running Shoe Book*, mountain View, CA, © 1980, pp. 176–180.

Williams, "Walking on Air," *Case Alumnus*, Fall 1989, vol. LXVII, No. 6, pp. 4–8.

Brooks advertisement, *Runner' World*, Jun. 1989, p. 56+3pp.

Nigg et al., "Influence of Heel Flare and Midsole Construction on Pronation, Supination, and Impact Forces for Heel–Toe Running," *International Journal of Sport Biomechanics*, 1988, vol. 4, No. 3, pp. 205–219.

Nigg et al., "The influence of lateral heel flare of running shoes on pronation and impact forces," *Medicine and Science in Sports and Exercise*, ©1987, vol. 19, No. 3, pp. 294–302.

Ellis, III, *Executive Summary*, two pages with Figures I–VII attached.

Johnson et al., << A Biomechanical Approach to the Design of Football Boots >>, *Journal of Biomechanics*, vol. 9, pp. 581–585 (1976).

Fixx, *The Complete Book of Running*, pp. 134–137 1977.

Romika Catalog, Summer 1978.

Adidas shoe, Model <<Water Competition >> 1980.

World Professional Squash Association Pro Tour Program, 1982–1983.

Williams et al., << The Mechanics of Foot Action During The GoldSwing and Implications for Shoe Design >>, *Medicine and Science in Sports and Exercise*, vol. 15, No. 3, pp 247–255 1983.

Nigg et al., << Biomechanical Aspects of Sport Shoes and Playing Surfaces >>, *Proceedings of the International Symposium on Biomechanical Aspects of Sport Shoes and Playing Surfaces*, 1983.

Valiant et al., << Study of Landing from a Jump : Implications for the Design of a Basketball Shoe >>, *Scientific Program of IX International Congress of Biomechanics*, 1983.

Frederick, *Sports Shoes and Playing Surfaces, Biomechanical Properties*, Entire Book, 1984.

Saucony Spot–bilt Catalog Supplement, Spring 1985.

Adidas shoe, Model << Fire >> 1985.

Adidas shoe, Model "Tolio H.", 1985.

Adidas shoe, Model "Buffalo" 1985.

Adidas shoe, Model, "Marathon" 86 1985.

Adidas shoe, Model << Boston Super >> 1985.

Leuthi et al., << Influence of Shoe Construction on Lower Extremity Kinematics and Load During Lateral Movements In Tennis >>, *International Journal of Sport Biomechanics,*, vol. 2, pp 166–174 1986.

Nigg et al., *Biomechanics of Running Shoes*, entire book, 1986.

Runner's World, Oct. 1986.

AVIA Catalog 1986.

Brooks Catalog 1986.

Adidas Catalog 1986.

Adidas shoe, Model << Questar >>, 1986.

Adidas shoe, Model "London" 1986.

Adidas shoe, Model << Marathon >> 1986.

Adidas shoe, Model << Tauern >> 1986.

Adidas shoe, Model << Kingscup Indoor >>, 1986.

Komi et al., "Interaction Between Man and Shoe in Running: Considerations for More Comprehensive Measurement Approach", *International Journal of Sports Medicine*, vol. 8, pp. 196–202 1987.

Nigg, et al., << The Influence of Lateral Heel Flare of Running Shoes on Protraction and Impact Forces >>, *Medicine and Science in Sports and Exercise* , vol. 19, No. 3, pp. 294–302 1987.

Nigg, << Biomechanical Analysis of Ankle and foot Movement >> *Medicine and Sport Science*, vol. 23, pp 22–29 1987.

Saucony Spot–bilt shoe, *The Complete Handbook of Athletic Footwear,* pp 332, 1987.

Puma basketball shoe, *The Complete Handbook of Athletic Footwear,* pp 315, 1987.

Adidas shoe, Model, << Indoor Pro >> 1987.

Adidas Catalog, 1987.

Adidas Catalog, Spring 1987.

Nike Fall Catalog 1987, pp 50–51.

Footwear Journal, Nike Advertisement, Aug. 1987.

Sporting Goods Business, Aug.. 1987.

Nigg et al., "Influence of Hell Flare and Midsole Construction on Pronation" *International Journal of Sport Biomechanics*, vol. 4, No. 3, pp 205–219, (1987).

Vagenas et al., << Evaluationm of Rearfoot Asymmetrics in Running With Worn and New Running Shoes << , *International Journal of Sport Biomechanics*, vol., 4, No. 4, pp 342–357 (1988).

Fineagan, "Comparison of the Effects of a Running Shoe and A Racing Flat on the Lower Extremity Biomechnical Alignment of Runners", *Journal of the American Physical Therapy Association* , vol., 68, No. 5, p 806 (1988).
Nawoczenside et al., << Effect of Rocker Sole Design on Plantar Forefoot Pressures >> *Journal of the American Podiatric Medical Association*, vol. 79, No. 9, pp 455–460, 1988.
Sprts Illustrated, Special Preview Issue, The Summer Olympics << Seoul '88 >> Reebok Advertisement.
Sports Illustrated, Nike Advertisement, Aug. 8, 1988.
Runner's World, "Shoe Review" Nov. 1988 pp 46–74.
Footwear Nows, Special Supplement, Feb. 8, 1988.
Footwear New, vol. 44, No. 37, Nike Advertisement (1988).
Saucony Spot–bilt Catalog 1988.
Runner's World, Apr. 1988.
Footwear News, Special Supplement, Feb. 8, 1988.
Kronos Catalog, 1988.
Avia Fall Catalog 1988.
Nike shoe, Model << High Jump 88 >>, 1988.
Nike shoe, Model << Zoom Street Leather >> 1988.
Nike shoe, Moel, << Leather Cortex® >>, 1988.
Nike shoe, Model << Air Revolution >> #15075, 1988.
Nike shoe, Model "Air Force" #1978, 1988.
Nike shoe, Model << Air Flow << #718, 1988.
Nike shoe, Model "Air " #1553, 1988.
Nike shoe, Model << Air >>, #13213 1988.
Nike shoe, Model << Air >>, #4183, 1988.
Nike Catalog, Footwear Fall, 1988.
Adidas shoe Model "Skin Racer" 1988.
Adidas shoe, Model << Tennis Comfort >> 1988.
Adidas Catlog 1988.
Segesser et al., "Surfing Shoe", *The Shoe in Sport*, 1989, (Translation of a book published in Germany in 1987), pp. 106–110.
Palamarchuk et al., "In shoe Casting Technique for Specialized Sports Shoes", *Journal of the America, Podiatric Medical Association*, vol. 79, No. 9, pp 462–465 1989.
Runner's World, "Spring Shoe Survey", pp 45–74.
Footwear News, vol. 45, No. 5, Nike Advertisement 1989.
Nike Spring Catalog 1989 pp 62–63.
Prince Cross–Sport 1989.
Adidas Catalog 1989.
Adidas Spring Catalog 1989.
Adidas Autumn Catalog 1989.
Nike Shoe, men's Cross–training Model "Air Trainer SC" 1989.
Nike shoe, men's cross–training Model << Air Trainer TW >> 1989.
Adidas shoe, Model "Torsion Grand Slam Indoor", 1989.
Adidas shoe, Model << Torsion ZC 9020 S >> 1989.
Adidas shoe, Model << Torison Special HI >> 1989.
Areblad et al., << Threee–Dimensional Measurement of Rearfoot Motion During Running >> *Journal of Biomechanics*, vol., 23, pp 933–940 (1990)
Cavanagh et al., "Biomechanics of Distance Running", Human Kinetics Books, pp 155–164 1990.
Adidas Catalog 1990.
Adidas Catalog 1991.
K–Swiss Catalog, Fall 1991.
Adidas' First Supplemental Responses to Interrogatory No. 1.
Complaint, Anatomic Research, Inc. and Frampton E. Ellis v. adidas America, Inc. Civil Action No. 01–1781–A.
Answer and Couterclaim of Defendent adidas America, Inc., Anatomic Research, Inc. And Frampton E. Ellis v. adidas America, Inc. Civil Action No. 01–1781–A dated Dec. 14, 2001.
Complaint, Anatomic Research, Inc. V. adidas America, Inc. Adidas Salomon North America, Inc. Adidas Sales, Inc. And adidas Promotional Retail Operations, Inc. Civil Action No. 2 :01cv960.
Answer and Counterclaim, Anatomic Research, Inc. V. adidas America, Inc. Adidas Salomon North America, Inc. Adidas Sales, Inc. And adidas Promotional Retail Oeprations, Inc. Civil Action No. 2 :01cv960 dated Jan. 14, 2002.
Adidas America, Inc. v. Anatomic Research, Inc. and Frampton E. Ellis III, adidas America Inc.'s Responses to Defendants' First Set of Interrogatories dated Jan. 28, 2002.
Adidas' Second Supplemental Responses to Interrogatory No. 1.

RIGHT FOOT

SHOES SOLE STRUCTURES

CROSS-REFERENCE TO RELATED APPLICATIONS

This application is a divisional of U.S. patent application Ser. No. 09/907,598 filed Jul. 19, 2001, which is a divisional of U.S. patent application Ser. No. 09/734,905, filed Dec. 13, 2000 U.S. Pat. No. 6,308,439, now pending, which is a continuation of U.S. patent application Ser. No. 08/477,954, filed Jun. 7, 1995, now U.S. Pat. No. 6,163,982, which is a continuation-in-part of U.S. patent application Ser. No. 08/376,661, filed Jan. 23, 1995, currently pending, which is a continuation of U.S. patent application Ser. No. 08/127,487, filed Sep. 28, 1993, now abandoned, which is a continuation of U.S. patent application Ser. No. 07/729,886, filed Jul. 11, 1991, now abandoned, which is a continuation of U.S. patent application Ser. No. 07/400,714, filed Aug. 30, 1989, now abandoned.

FIELD AND BACKGROUND OF THE INVENTION

This invention relates generally to the structure of soles of shoes and other footwear, including soles of street shoes, hiking boots, sandals, slippers, and moccasins. More specifically, this invention relates to the structure of athletic shoe soles, including such examples as basketball and running shoes.

Still more particularly, this invention relates to variations in the structure of such soles using a theoretically ideal stability plane as a basic concept.

The applicant has introduced into the art the concept of a theoretically ideal stability plane as a structural basis for shoe sole designs. The theoretically ideal stability plane was defined by the applicant in previous copending applications as the plane of the surface of the bottom of the shoe sole, wherein the shoe sole conforms to the natural shape of the wearer's foot sole, particularly its sides, and has a constant thickness in frontal or transverse plane cross sections. Therefore, by definition, the theoretically ideal stability plane is the surface plane of the bottom of the shoe sole that parallels the surface of the wearer's foot sole in transverse or frontal plane cross sections.

The theoretically ideal stability plane concept as implemented into shoes such as street shoes and athletic shoes is presented in U.S. Pat. No. 4,989,349, issued Feb. 5, 1991 and U.S. Pat. No. 5,317,819, issued Jun. 7, 1994, both of which are incorporated by reference, as well as U.S. Pat. No. 5,544,429 issued Aug. 13, 1996; U.S. Pat. No. 4,989,349 issued from U.S. patent application Ser. No. 07/219,387. U.S. Pat. No. 5,317,819 issued from U.S. patent application Ser. No. 07/239,667.

This new invention is a modification of the inventions disclosed and claimed in the earlier applications and develops the application of the concept of the theoretically ideal stability plane to other shoe structures. Each of the applicant's applications is built directly on its predecessors and therefore all possible combinations of inventions or their component elements with other inventions or elements in prior and subsequent applications have always been specifically intended by the applicant. Generally, however, the applicant's applications are generic at such a fundamental level that it is not possible as a practical matter to describe every embodiment combination that offers substantial improvement over the existing art, as the length of this description of only some combinations will testify.

Accordingly, it is a general object of this invention to elaborate upon the application of the principle of the theoretically ideal stability plane to other shoe structures.

The purpose of this application is to specifically describe some of the most important combinations, especially those that constitute optimal ones.

Existing running shoes are unnecessarily unsafe. They profoundly disrupt natural human biomechanics. The resulting unnatural foot and ankle motion leads to what are abnormally high levels of running injuries.

Proof of the unnatural effect of shoes has come quite unexpectedly from the discovery that, at the extreme end of its normal range of motion, the unshod bare foot is naturally stable, almost unsprainable, while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that the stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. It is easy enough to be duplicated and verified by anyone; it only takes a few minutes and requires no scientific equipment or expertise. The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implications of this uniquely unambiguous discovery are potentially far-reaching. The same fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

These and other objects of the invention will become apparent from a detailed description of the invention which follows taken with the accompanying drawings.

BRIEF SUMMARY OF THE INVENTION

In its simplest conceptual form, the applicant's invention is the structure of a conventional shoe sole that has been modified by having its sides bent up so that their inner surface conforms to a shape nearly identical (instead of the shoe sole sides being flat on the ground, as is conventional). This concept is like that described in FIG. 3 of the applicant's 5,317,819 Patent ("the '819 patent"); for the applicant's fully contoured design described in FIG. 15 of the '819 patent, the entire shoe sole—including both the sides and the portion directly underneath the foot—is bent up to conform to a shape nearly identical but lightly smaller than the contoured shape of the unloaded foot sole of the wearer, rather than the partially flattened load-bearing foot sole shown in FIG. 3.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the remaining soles layers, including the insole, midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.)

Consequently, in existing contoured shoe soles, the total shoe sole thickness of the contoured side portions, including every layer or portion, is much less than the total thickness of the sole portion directly underneath the foot, whereas in the applicant's shoe sole inventions the shoe sole thickness of the contoured side portions are at least similar to the thickness of the sole portion directly underneath the foot.

This major and conspicuous structural difference between the applicant's underlying concept and the existing shoe sole art is paralleled by a similarly dramatic functional difference between the two: the aforementioned equivalent or similar thickness of the applicant's shoe sole invention maintains intact the firm lateral stability of the wearer's foot, that stability as demonstrated when the foot is unshod and tilted out laterally in inversion to the extreme limit of the normal range of motion of the ankle joint of the foot. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness and material density of the shoe sole sides and their specific contour will be determined empirically for individuals and groups using standard biomechanical techniques of gait analysis to determine those combinations that best provide the barefoot stability described above.

In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

Directed to achieving the aforementioned objects and to overcoming problems with prior art shoes, a shoe according to the invention comprises a sole having at least a portion thereof following the contour of a theoretically ideal stability plane, and which further includes rounded edges at the finishing edge of the sole after the last point where the constant shoe sole thickness is maintained. Thus, the upper surface of the sole does not provide an unsupported portion that creates a destabilizing torque and the bottom surface does not provide an unnatural pivoting edge.

In another aspect of the invention, the shoe includes a naturally contoured sole structure exhibiting natural deformation which closely parallels the natural deformation of a foot under the same load. In a preferred embodiment, the naturally contoured side portion of the sole extends to contours underneath the load-bearing foot. In another embodiment, the sole portion is abbreviated along its sides to essential support and propulsion elements wherein those elements are combined and integrated into the same discontinuous shoe sole structural elements underneath the foot, which approximate the principal structural elements of a human foot and their natural articulation between elements. The density of the abbreviated shoe sole can be greater than the density of the material used in an unabbreviated shoe sole to compensate for increased pressure loading. The essential support elements include the base and lateral tuberosity of the calcaneus, heads of the metatarsal, and the base of the fifth metatarsal.

The shoe sole of the invention is naturally contoured, paralleling the shape of the foot in order to parallel its natural deformation, and made from a material which, when under load and tilting to the side, deforms in a manner which closely parallels that of the foot of its wearer, while retaining nearly the same amount of contact of the shoe sole with the ground as in its upright state under load.

These and other features of the invention will become apparent from the detailed description of the invention which follows.

BRIEF DESCRIPTION OF THE DRAWINGS

FIGS. 1A to 11 illustrate functionally the principles of natural deformation.

FIG. 2 shows variations in the relative density of the shoe sole including the shoe insole to maximize an ability of the sole to deform naturally.

FIG. 3 is a rear view of a heel of a foot for explaining the use of a stationery sprain simulation test.

FIG. 4 is a rear view of a conventional running shoe unstably rotating about an edge of its sole when the shoe sole is tilted to the outside.

FIG. 6 is a view similar to FIG. 3 but showing further continued rotation of a foot in a shoe of the type shown in FIG. 2.

FIG. 7 is a force diagram during rotation of a shoe having motion control devices and heel counters.

FIG. 8 is another force diagram during rotation of a shoe having a constant shoe sole thickness, but producing a destabilizing torque because a portion of the upper sole surface is unsupported during rotation.

FIG. 9 shows an approach for minimizing destabilizing torque by providing only direct structural support and by rounding edges of the sole and its outer and inner surfaces.

FIG. 11 is a diagram serving as a basis for an expanded discussion of a correct approach for measuring shoe sole thickness.

DETAILED DESCRIPTION OF THE PREFERRED EMBODIMENTS

Figure 1A:
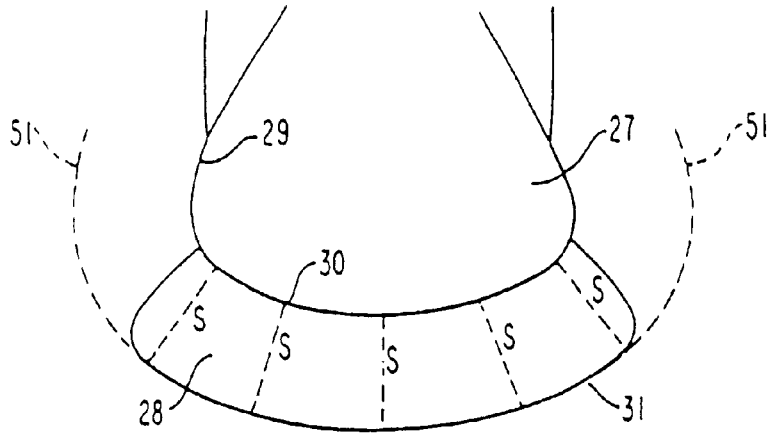
Figure 1B:
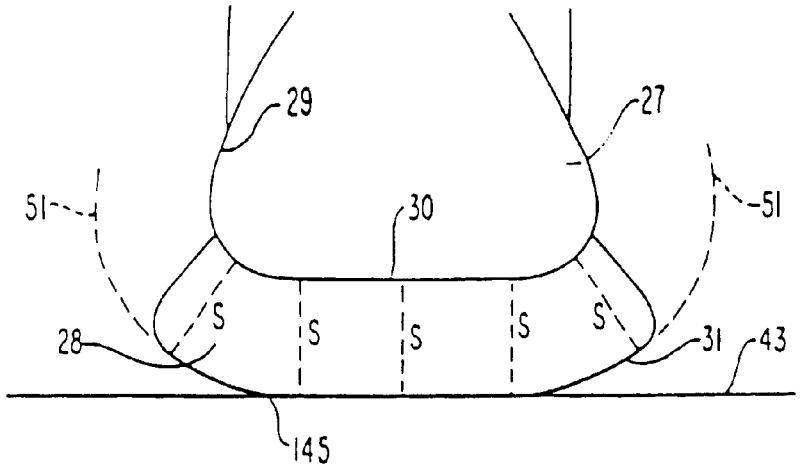
Figure 1C:
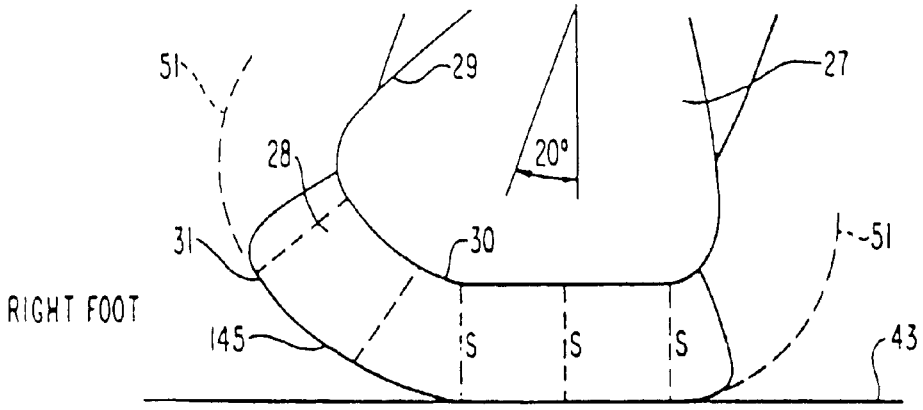
Figure 1D:
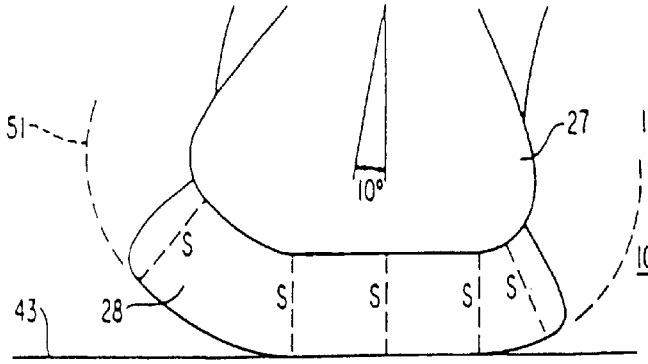
Figure 1G:
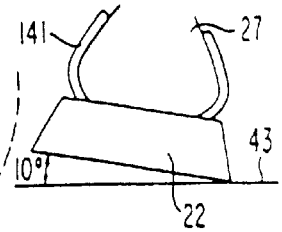
Figure 1E:
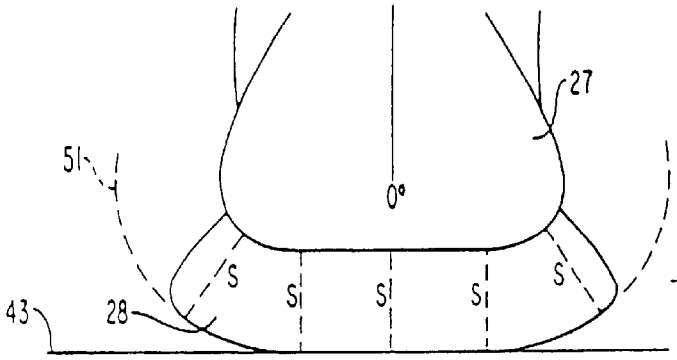
Figure 1H:
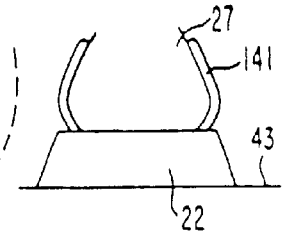
Figure 1F:
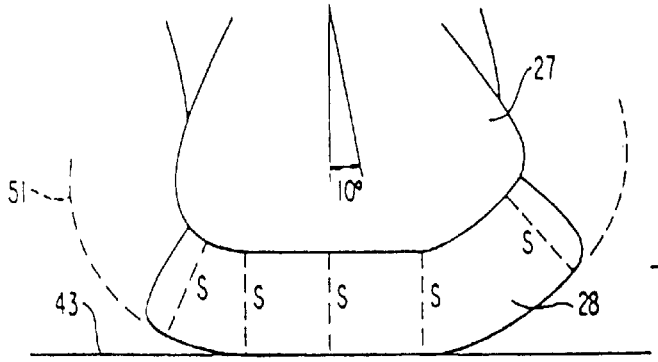
Figure 1I:
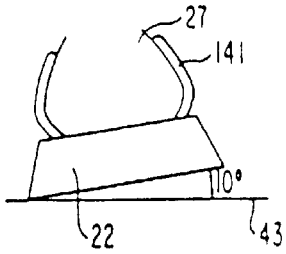

FIGS. 1A–C illustrate, in frontal plane cross sections in the heel area, the applicant's concept of the theoretically ideal stability plane applied to shoe soles.

FIGS. 1A–1C illustrate clearly the principle of natural deformation as it applies to the applicant's design, even though design diagrams like those preceding (and in his previous applications already referenced) are normally shown in an ideal state, without any functional deformation, obviously to show their exact shape for proper construction. That natural structural shape, with its contour paralleling the foot, enables the shoe sole to deform naturally like the foot. In the applicant's invention, the natural deformation feature creates such an important functional advantage it will be illustrated and discussed here fully. Note in the figures that even when the shoe sole shape is deformed, the constant shoe sole thickness in the frontal plane feature of the invention is maintained.

FIG. 1A shows a fully contoured shoe sole design that follows the natural contour of all of the foot sole, the bottom as well as the sides. The fully contoured shoe sole assumes that the resulting slightly rounded bottom when unloaded will deform under load as shown in FIG. 1B and flatten just as the human foot bottom is slightly round unloaded but flattens under load. Therefore, the shoe sole material must be of such composition as to allow the natural deformation following that of the foot. The design applies particularly to the heel, but to the rest of the shoe sole as well. By providing the closes match to the natural shape of the foot, the fully contoured design allows the foot to function as naturally as possible. Under load, FIG. 1A would deform by flattening to look essentially like FIG. 1B.

FIGS. 1A and 1B show in frontal plane cross section the essential concept underlying this invention, the theoretically ideal stability plane which is also theoretically ideal for efficient natural motion of all kinds, including running, jogging or walking. For any given individual, the theoretically ideal stability plane 51 is determined, first, by the desired shoe sole thickness (s) in a frontal plane cross section, and, second, by the natural shape of the individual's foot surface 29.

For the case shown in FIG. 1B, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint which is defined as the supper surface of the shoe sole that is in physical contact with and supports the human foot sole.

FIG. 1B shows the same fully contoured design when upright, under normal load (body weight) and therefore deformed naturally in a manner very closely paralleling the natural deformation under the same load of the foot. An almost identical portion of the foot sole that is flattened in deformation is also flatten in deformation in the shoe sole.

FIG. 1C shows the same design when tilted outward 20 degrees laterally, the normal barefoot limit; with virtually equal accuracy it shows the opposite foot tilted 20 degrees inward, in fairly severe pronation. As shown, the deformation of the shoe sole 28 again very closely parallels that of the foot, even as it tilts. Just as the area of foot contact is almost as great when tilted 20 degrees, the flattened area of the deformed shoe sole is also nearly the same as when upright. Consequently, the barefoot fully supported structurally and its natural stability is maintained undiminished, regardless of shoe tilt. In marked contrast, a conventional shoe, shown in FIG. 3, makes contact with the ground with only its relatively sharp edge when tilted and is therefore inherently unstable.

The capability to deform naturally is a design feature of the applicant's naturally contoured shoe sole designs, whether fully contoured or contoured only at the sides, though the fully contoured design is most optimal and is the most natural, general case, as note in the referenced Sep. 2, 1988, Application, assuming shoe sole material such as to allow natural deformation. It is an important feature because, by following the natural deformation of the human foot, the naturally deforming shoe sole can avoid interfering with the natural biomechanics of the foot and ankle.

FIG. 1C also represents with reasonable accuracy a shoe sole design corresponding to FIG. 1B, a naturally contoured shoe sole with a conventional built-in flattening deformation, except that design would have a slight crimp at 145. Seen in this light, the naturally contoured side design in FIG. 1B is a more conventional, conservative design that is a special case of the more generally fully contoured design in FIG. 1A, which is the closest to the natural form of the foot, but the least conventional.

Figure 3:
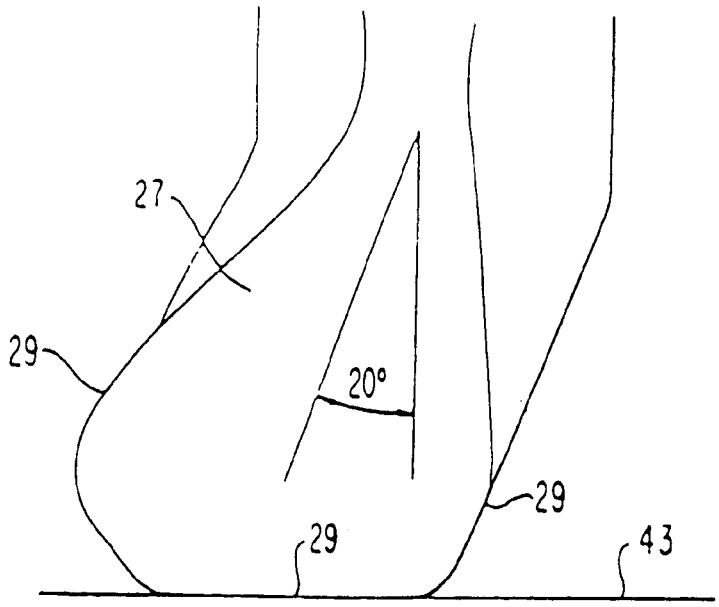

In its simplest conceptual form, the applicant's FIG. 1 invention is the structure of a conventional shoe sole that has been modified by having its sides bent up so that their inner surface conforms to the shape of the outer surface of the foot sole of the wearer (instead of the shoe sole sides being flat on the ground, as is conventional); this concept is like that described in FIG. 3 of the applicant's '819 patent. For the applicant's fully contoured design, the entire shoe sole—including both the sides and the portion directly underneath the foot—is bent up to conform to the shape of the unloaded foot sole of the wearer, rather than the partially flattened load-bearing foot sole shown in FIG. 3 of the '819 patent.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It Is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearer's foot soles; the remaining sole layers, including the insole, the midsole and the heel lift (or heel) of such shoe soles, constituting over half of the thickness of the entire shoe sole, remains flat, conforming to the ground rather than the wearers' feet.

Consequently, in existing contoured shoe soles, the shoe sole thickness of the contoured side portions is much less than the bare foot, it will deform easily to provide this designed-in custom fit. The greater the flexibility of the shoe sole sides, the greater the range of individual foot size. This approach applies to the fully contoured design described here in FIG. 1A and In FIG. 15 of the '819 patent.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearers foot sole or to the ground or some intermediate position, including a shape much smaller than the wearer's foot sole—that deforms to conform to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function in accordance with the applicant's general invention, since the flexible sides could bend out easily a considerable relative distance and still conform to the wearer's foot sole when on the wearer's foot.

FIG. 3 shows in a real illustration a foot 27 in position for a new biomechanical test that is the basis for the discovery that ankle sprains are in fact unnatural for the bare foot. The test simulates a lateral ankle sprain, where the foot 27—on the ground 43—rolls or tilts to the outside, to the extreme end of its normal range of motion, which is usually about 20 degrees at the heel 29, as shown in a rear view of a bare (right) heel in FIG. 3. Lateral (inversion) sprains are the most common ankle sprains, accounting for about three-fourths of all.

The especially novel aspect of the testing approach is to perform the ankle spraining simulation while standing stationary. The absence of forward motion is the key to the dramatic success of the test because otherwise it is impossible to recreate for testing purposes the actual foot and ankle motion that occurs during a lateral ankle sprain, and simultaneously to do it in a controlled manner, while at normal running speed or even jogging slowly, or walking. Without the critical control achieved by slowing forward motion all the way down to zero, any test subject would end up with a sprained ankle.

That is because actual running in the real world is dynamic and involves a repetitive force maximum of three times one's full body weight for each footstep, with sudden peaks up to roughly five or six times for quick stops, missteps, and direction changes, as might be experienced when spraining an ankle. In contrast, in the static simulation test, the forces are tightly controlled and moderate, ranging from no force at all up to whatever maximum amount that is comfortable.

The Stationary Sprain Simulation Test (SSST) consists simply of standing stationary with one foot bare and the other shod with any shoe. Each foot alternately is carefully tilted to the outside up to the extreme end of its range of motion, simulating a lateral ankle sprain.

The Stationary Sprain Simulation Test clearly identifies what can be no less than a fundamental flaw in existing shoe design. It demonstrates conclusively that nature's biomechanical system, the bare foot, is far superior in stability to man's artificial shoe design. Unfortunately, it also demonstrates that the shoe's severe instability overpowers the natural stability of the human foot and synthetically creates a combined biomechanical system that is artificially unstable. The shoe is the weak link.

The test shows that the bare foot is inherently stable at the approximate 20 degree end of normal joint range because of the wide, steady foundation the bare heel 29 provides the ankle joint, as seen in FIG. 3. In fact, the area of physical contact of the bare heel 29 with the ground 43 is not much less when tilted all the way out to 20 degrees as when upright at 0 degrees.

The new Stationary Sprain Simulation Test provides a natural yardstick, totally missing until now, to determine whether any given shoe allows the foot within it to function naturally. If a shoe cannot pass this simple litmus test, it is positive proof that a particular shoe is interfering with natural foot and ankle biomechanics. The only question is the exact extent of the interference beyond that demonstrated by the new test.

Conversely, the applicant's designs are the only designs with shoe soles thick enough to provide cushioning (thin-soled and heel-less moccasins do pass the test, but do not provide cushioning and only moderate protection) that will provide naturally stable performance, like the bare foot, in the Stationary Sprain Simulation Test.

Figure 4:
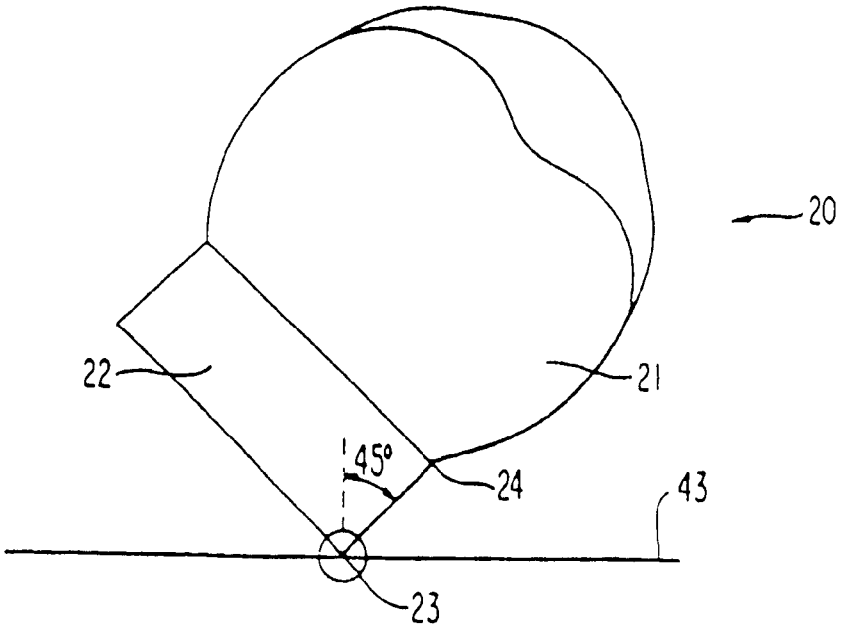

FIG. 4 shows that, in complete contrast the foot equipped with a conventional running shoe, designated generally by the reference numeral 20 and having an upper 21, though Initially very stable while resting completely flat on the ground, becomes immediately unstable when the shoe sole 22 is tilted to the outside. The tilting motion lifts from contact with the ground all of the shoe sole 22 except the artificially sharp edge of the bottom outside corner. The shoe sole instability increases the farther the foot is rolled laterally. Eventually, the instability induced by the shoe itself is so great that the normal load-bearing pressure of full body weight would actively force an ankle sprain if not controlled. The abnormal tilting motion of the shoe does not stop at the barefoot's natural 20 degree limit, as you can see from the 45 degree tilt of the shoe heel in FIG. 4.

That continued outward rotation of the shoe past 20 degrees causes the foot to slip within the shoe, shifting its position within the shoe to the outside edge, further increasing the shoe's structural instability. The slipping of the foot within the shoe is caused by the natural tendency of the foot to slide down the typically flat surface of the tilted shoe sole; the more the tilt, the stronger the tendency. The heel is shown in FIG. 4 because of its primary importance in sprains due to its direct physical connection to the ankle ligaments that are tom in an ankle sprain and also because of the heel's predominant role within the foot in bearing body weight.

It is easy to see in the two figures how totally different the physical shape of the natural bare foot is compared to the shape of the artificial shoe sole. It is strikingly odd that the two objects, which apparently both have the same biomechanical function, have completely different physical shapes. Moreover, the shoe sole clearly does not deform the same way the human foot sole does, primarily as a consequence of its dissimilar shape.

Figure 5A:
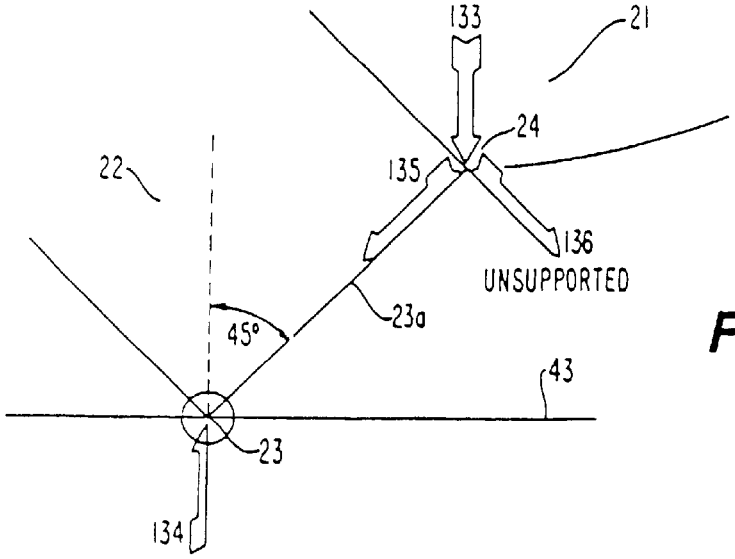
FIGS. 5A and 5B are diagrams of the forces on a foot when rotating in a shoe of the type shown in FIG. 2.

FIG. 5A illustrates that the underlying problem with existing shoe designs is fairly easy to understand by looking closely at the principal forces acting on the physical structure of the shoe sole. When the shoe is tilted outwardly, the weight of the body held In the shoe upper 21 shifts automatically to the outside edge of the shoe sole 22. But, strictly due to its unnatural shape, the tilted shoe sole 22 provides absolutely no supporting physical structure directly underneath the shifted body weight where it is critically needed to support that weight. An essential part of the supporting foundation is missing. The only actual structural support comes from the sharp corner edge 23 of the shoe sole 22, which unfortunately is not directly under the force of the body weight after the shoe is tilted. Instead, the corner edge 23 is offset well to the inside.

As a result of that unnatural misalignment, a lever arm 23*a* is set up through the shoe sole 22 between two interacting forces (called a force couple): the force of gravity on the body (usually known as body weight 133) applied at the point 24 in the upper 21 and the reaction force 134 of the ground, equal to and opposite to body weight when the shoe is upright. The force couple creates a force moment, commonly called torque, that forces the shoe 20 to rotate to the outside around the sharp corner edge 23 of the bottom sole 22, which serves as a stationary pivoting point 23 or center of rotation.

Unbalanced by the unnatural geometry of the shoe sole when tilted, the opposing two forces produce torque, causing the shoe 20 to tilt even more. As the shoe 20 tilts further, the torque forcing the rotation becomes even more powerful, so the tilting process becomes a self-reinforcing cycle. The more the shoe tilts, the more destabilizing torque is produced to further increase the tilt.

The problem may be easier to understand by looking at the diagram of the force components of body weight shown in FIG. 5A.

When the shoe sole 22 is tilted out 45 degrees, as shown, only half of the downward force of body weight 133 is physically supported by the shoe sole 22; the supported force component 135 is 71% of full body weight 133. The other half of the body weight at the 45 degree tilt is unsupported physically by any shoe sole structure; the unsupported component Is also 71% of full body weight 133. It therefore produces strong destabilizing outward tilting rotation, which is resisted by nothing structural except the lateral ligaments of the ankle.

Figure 5B:
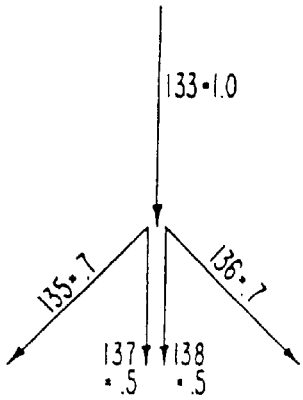

FIG. 5B show that the full force of body weight 133 is split at 45 degrees of tilt into two equal components: supported 135 and unsupported 136, each equal to 0.707 of full body weight 133. The two vertical components 137 and 138 of body weight 133 are both equal to 0.50 of full body weight. The ground reaction force 134 is equal to the vertical component 137 of the supported component 135.

Figure 6:
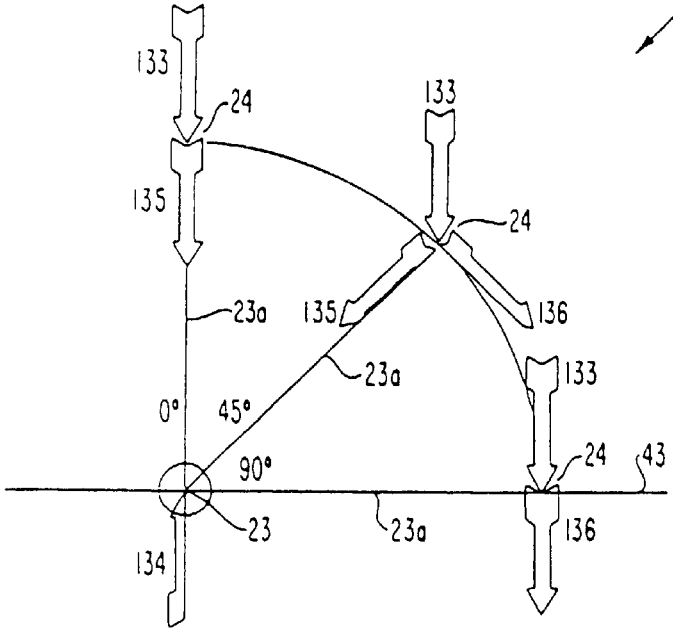

FIG. 6 show a summary of the force components at shoe sole tilts of 0, 45 and 90 degrees. FIG. 6, which uses the same reference numerals as in FIG. 5, shows that, as the outward rotation continues to 90 degrees, and the foot slips within the shoe while ligaments stretch and/or break, the destabilizing unsupported force component 136 continues to grow. When the shoe sole has tilted all the way out to 90 degrees (which unfortunately does happen In the real world), the sole 22 is providing no structural support and there is no supported force component 135 of the full body weight 133. The ground reaction force at the pivoting point 23 is zero, since it would move to the upper edge 24 of the shoe sole.

At that point of 90 degree tilt, all of the full body weight 133 is directed into the unresisted and unsupported force component 136, which is destabilizing the shoe sole very powerfully. In other words, the full weight of the body is physically unsupported and therefore powering the outward rotation of the shoe sole that produces an ankle sprain. Insidiously, the farther ankle ligaments are stretched, the greater the force on them.

In stark contrast, untilted at 0 degrees, when the shoe sole is upright, resting flat on the ground, all of the force of body weight 133 is physically supported directly by the shoe sole and therefore exactly equals the supported force component 135, as also shown in FIG. 6. In the untilted position, there is no destabilizing unsupported force component 136.

Figure 7:
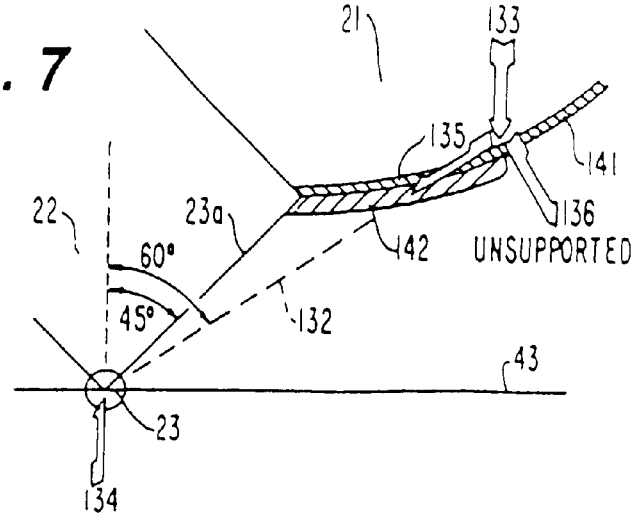

FIG. 7 illustrates that the extremely rigid heel counter 141 typical of existing athletic shoes, together with the motion control device 142 that are often used to strongly reinforce those heel counters (and sometimes also the sides of the mid- and forefoot), are ironically counterproductive. Though they are intended to increase stability, in fact they decrease it. FIG. 7 shows that when the shoe 20 is tilted out, the foot is shifted within the upper 21 naturally against the rigid structure of the typical motion control device 142, Instead of only the outside edge of the shoe sole 22 itself. The motion control support 142 increases by almost twice the effective lever arm 132 (compared to 23*a*) between the force couple of body weight and the ground reaction force at the pivot point 23. It doubles the destabilizing torque and also increases the effective angle of tilt so that the destabilizing force component 136 becomes greater compared to the supported component 135, also increasing the destabilizing torque. To the extent the foot shifts further to the outside, the problem becomes worse. Only by removing the heel counter 141 and the motion control devices 142 can the extension of the destabilizing lever arm be avoided. Such an approach would primarily rely on the applicant's contoured shoe sole to "cup" the foot (especially the heel), and to a much lesser extent the non-rigid fabric or other flexible material of the upper 21, to position the foot, including the heel, on the shoe. Essentially, the naturally contoured sides of the applicant's shoe sole replace the counter-productive existing heel counters and motion control devices, including those which extend around virtually all of the edge of the foot.

Figure 8:
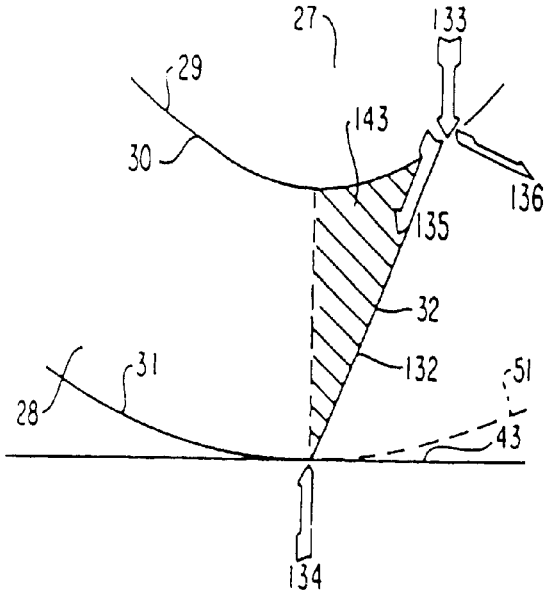

FIG. 8 shows that the same kind of torsional problem, though to a much more moderate extent, can be produced in the applicant's naturally contoured design of the applicant's earlier filed applications. There, the concept of a theoretically-ideal stability plane was developed in terms of a sole 28 having a lower surface 31 and an upper surface 30 which are spaced apart by a predetermined distance which remains constant throughout the sagittal frontal planes. The outer surface 27 of the foot is in contact with the upper surface 30 of the sole 28. Though it might seem desirable to extend the inner surface 30 of the shoe sole 28 up around the sides of the foot 27 to further support it (especially in creating anthropomorphic designs), FIG. 8 indicates that only that portion of the inner shoe sole 28 that is directly supported structurally underneath by the rest of the shoe sole is effective in providing natural support and stability. Any point on the upper surface 30 of the shoe sole 28 that is not supported directly by the constant shoe sole thickness (as measured by a perpendicular to a tangent at that point and shown in the shaded area 143) will tend to produce a moderate destabilizing torque. To avoid creating a destabilizing lever arm 132, only the supported contour sides and non-rigid fabric or other material can be used to position the foot on the shoe sole 28.

Figure 9:
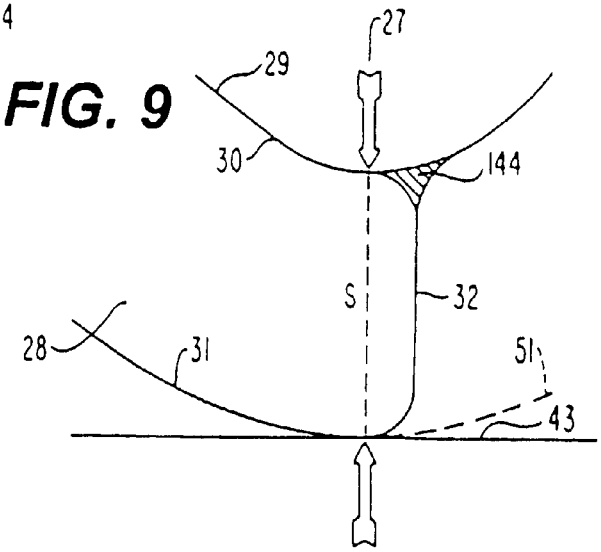

FIG. 9 illustrates an approach to minimize structurally the destabilizing lever arm 32 and therefore the potential torque problem. After the last point where the constant shoe sole thickness (s) is maintained, the finishing edge of the shoe sole 28 should be tapered gradually inward from both the top surface 30 and the bottom surface 31, in order to provide matching rounded or semi-rounded edges In that way, The upper surface 30 does not provide an unsupported portion that creates a destabilizing torque and the bottom surface 31 does not provide an unnatural pivoting edge. The gap 144 between shoe sole 28 and foot sole 29 at the edge of the shoe sole can be "caulked" with exceptionally soft sole material as indicated in FIG. 9 that, in the aggregate (i.e. all the way around the edge of the shoe sole), will help position the foot in the shoe sole. However, at any point of pressure when the shoe tilts, it will deform easily so as not to form an unnatural lever causing a destabilizing torque.

FIG. 10 illustrates a fully contoured design, but abbreviated along the sides to only essential structural stability and propulsion shoe sole elements as shown in FIG. 21 of the '819 patent combined with the freely articulating structural elements underneath the foot as shown in FIG. 28 of the '819 patent. The unifying concept is that, on both the sides and underneath the main load-bearing portions of the shoe sole, only the important structural (i.e. bone) elements of the foot should be supported by the shoe sole, if the natural flexibility of the foot is to be paralleled accurately in shoe sole flexibility, so that the shoe sole does not interfere with the foot's natural motion. In a sense, the shoe sole should be composed of the same main structural elements as the foot and they should articulate with each other just as do the main joints of the foot.

Figure 10A:
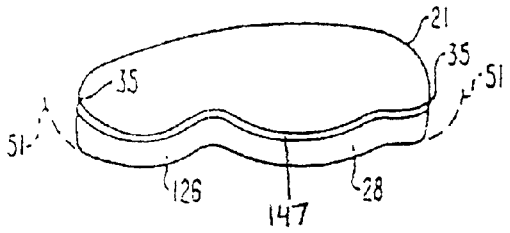
FIGS. 10A, 10B, 10C, 10D, 10E, 10F, 10G, 10H, 10I, and 10J show a shoe sole having a fully contoured design but having sides which are, abbreviated to the essential structural stability and propulsion elements that are combined and integrated into discontinuous structural elements underneath the foot that simulate those of the foot.
Figure 10B:
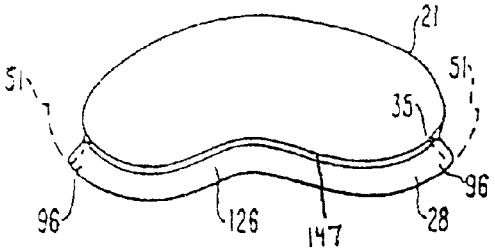
Figure 10C:
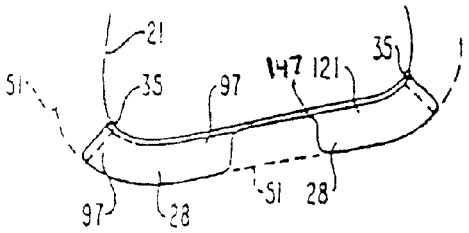
Figure 10D:
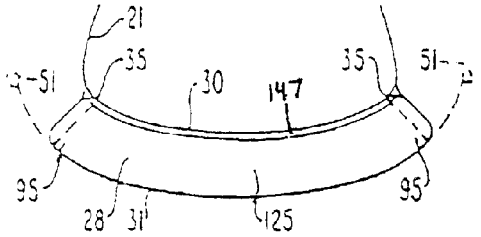
Figure 10E:
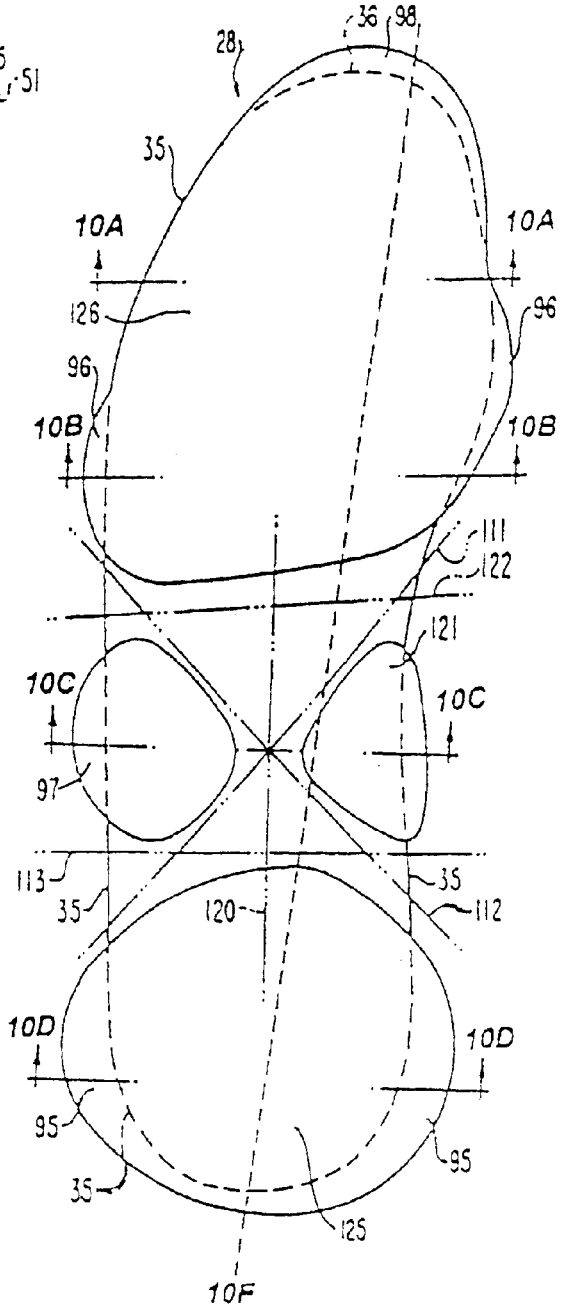
Figure 10E:
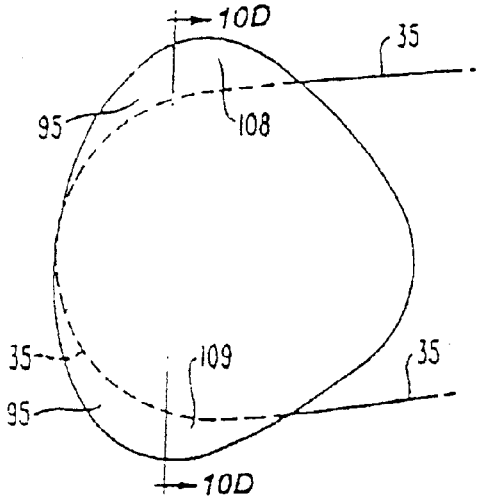

FIG. 10E shows the horizontal plane bottom view of the right foot corresponding to the fully contoured design previously described, but abbreviated, that is, having indentations along the sides to only essential structural support and propulsion elements which are all concavely rounded bulges as shown. The concavity of the bulges exists with respect to an intended wearer's foot location in the shoe. The essential structural support elements are the base and lateral tuberosity of the calcaneus 95, the heads of the metatarsals 96, and the base of the fifth metatarsal 97 (and the adjoining cuboid in some individuals). They must be supported both underneath and to the outside edge of the foot for stability. The essential propulsion element is the head of the first distal phalange 98. FIG. 10 shows that the naturally contoured stability sides need not be used except in the identified essential areas. Weight savings and flexibility improvements can be made by omitting the non-essential stability sides.

The design of the portion of the-shoe sole directly underneath the foot shown in FIG. 10 allows for unobstructed natural inversion/eversion motion of the calcaneus by providing maximum shoe sole flexibility particularly at a mid-tarsal portion of the sole member, between the base of the calcaneus 125 (heel) and the metatarsal heads 126 (forefoot) along an axis 120. An unnatural torsion occurs about that axis if flexibility is insufficient so that a conventional shoe sole interferes with the inversion/eversion motion by restraining it. The object of the design is to allow the relatively more mobile (in inversion and eversion) calcaneus to articulate freely and independently from the relatively more fixed forefoot instead of the fixed or fused structure or lack of stable structure between the two in conventional designs. In a sense, freely articulating joints are created in the shoe sole that parallel those of the foot. The design is to remove, nearly all of the shoe sole material between the heel and the forefoot, except under one of the previously described essential structural support elements, the base of the fifth metatarsal 97. An optional support for the main longitudinal arch 121 may also be retained for runners with substantial foot pronation, although would not be necessary for many runners.

The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design; various aggregations of the subdivision are also possible.

The design in FIG. 10 features an enlarged structural support at the base of the fifth metatarsal in order to Include the cuboid, which can also come into contact with the ground under arch compression in some individuals. In addition, the design can provide general side support in the heel area, as in FIG. 10E or alternatively can carefully orient the stability sides in the heel area to the exact positions of the lateral calcaneal tuberosity 108 and the main base of the calcaneus 109, as in FIG. 10E (showing heel area only of the right foot). FIGS. 10A–D show frontal plane cross sections of the left shoe and FIG. 10E shows a bottom view of the right foot, with flexibility axes 120, 122, 111, 112 and 113 indicated. FIG. 10F shows a sagittal plane cross section showing the structural elements joined by very thin and relatively soft upper midsole layer 147. FIGS. 10G and 10H show similar cross sections with slightly different designs featuring durable fabric only (slip-lasted shoe), or a structurally sound arch design, respectively. FIG. 10I shows a side medial view of the shoe sole.

Figure 10J:
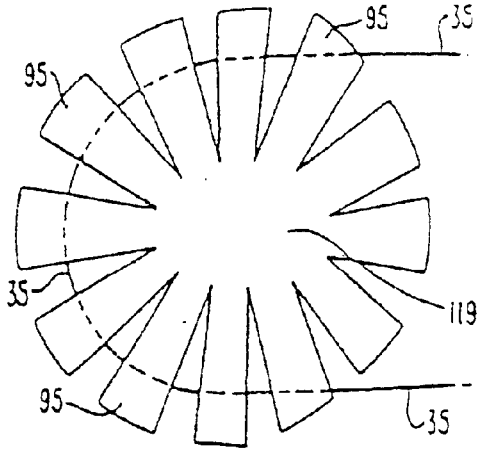
Figure 10F:
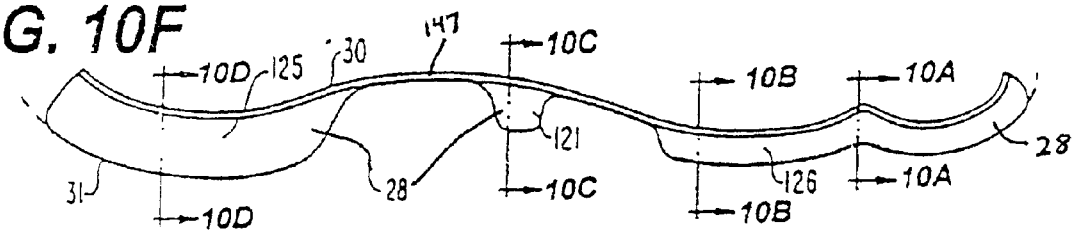
Figure 10G:
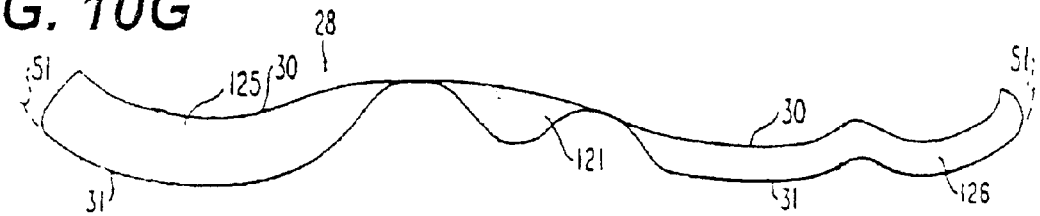
Figure 10H:
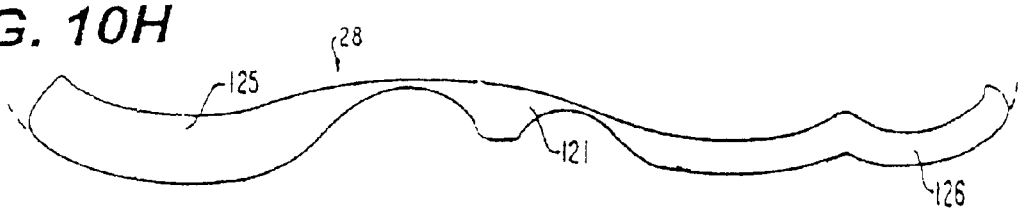
Figure 10I:
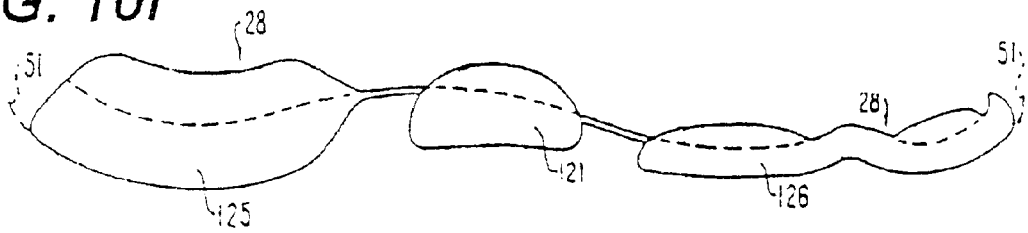

FIG. 10J shows a simple interim or low cost construction for the articulating shoe sole support element 95 for the heel (showing the heel area only of the right foot); while it is most critical and effective for the heel support element 95, it can also be used with the other elements, such as the base of the fifth metatarsal 97 and the long arch 121. The heel sole element 95 shown can be a single flexible layer or a lamination of layers. When cut from a flat sheet or molded in the general pattern shown, the outer edges can be easily bent to follow the contours of the foot, particularly the sides. The shape shown allows a flat or slightly contoured heel element 95 to be attached to a highly contoured shoe upper or very thin upper sole layer like that shown in FIG. 10F. Thus, a very simple construction technique can yield a highly sophisticated shoe sole design. The size of the center section 119 can be small to conform to a fully or nearly fully contoured design or larger to conform to a contoured sides design, where there is a large flattened sole area under the heel. The flexibility is provided by the removed diagonal sections, the exact proportion of size and shape can vary.

Figure 11:
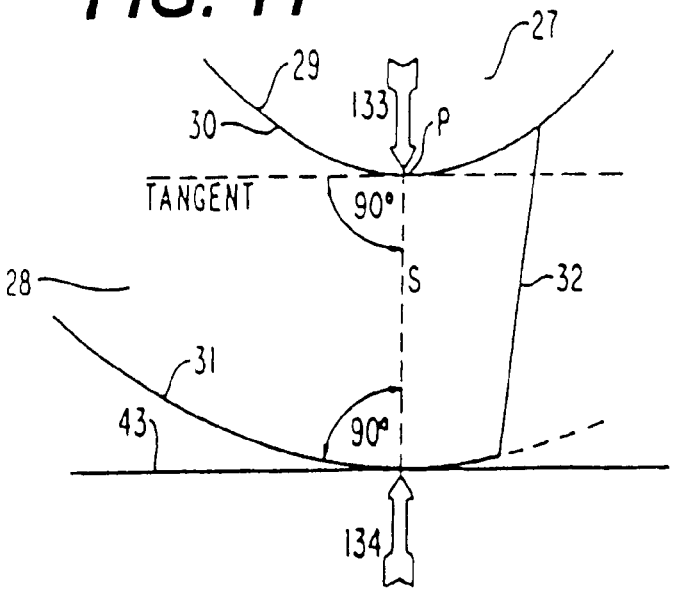

FIG. 11 illustrates an expanded explanation of the correct approach for measuring shoe sole thickness according to the naturally contoured design, as described previously in FIGS. 23 and 24 of the '819 patent. The tangent described in those figures would be parallel to the ground when the shoe sole is tilted out sideways, so that measuring shoe sole thickness along the perpendicular will provide the least distance between the point on the upper shoe sole surface closest to the ground and the closest point to it on the lower surface of the shoe sole (assuming no load deformation).

Figure 12:
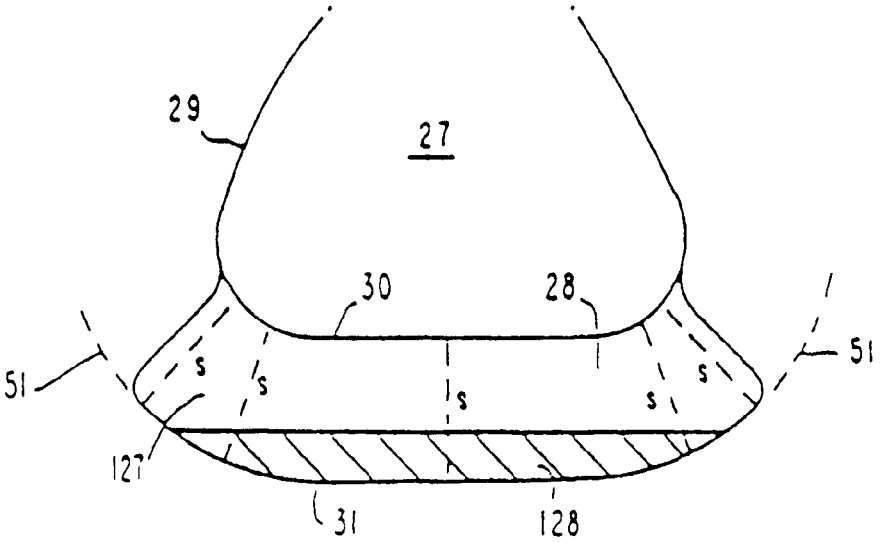
FIG. 12 shows an embodiment wherein the bottom sole includes most or all of the special contours of the new designs and retains a flat upper surface.

FIG. 12 shows a non-optimal but interim or low cost approach to shoe sole construction, whereby the midsole and heel lift 127 are produced conventionally, or nearly so (at least leaving the midsole bottom surface flat, though the sides can be contoured), while the bottom or outer sole 128 includes most or all of the special contours of the new design. Not only would that completely or mostly limit the special contours to the bottom sole, which would be molded specially, it would also ease assembly, since two flat surfaces of the bottom of the midsole and the top of the bottom sole could be mated together with less difficulty than two contoured surfaces, as would be the case otherwise. The advantage of this approach is seen in the naturally contoured design example illustrated in FIG. 12A, which shows some contours on the relatively softer midsole sides, which are subject to less wear but benefit from greater traction for stability and ease of deformation, while the relatively harder contoured bottom sole provides good wear for the load-bearing areas.

Figure 13:
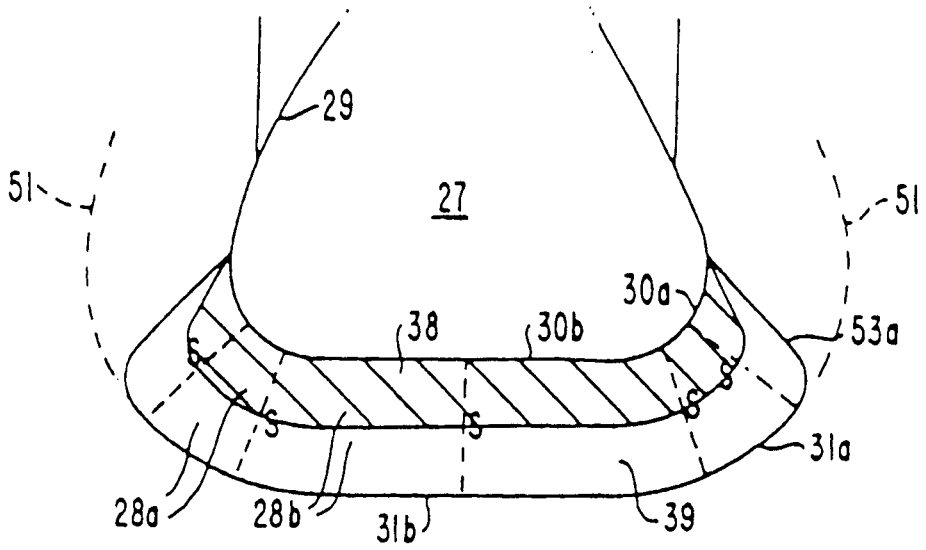
FIG. 13 shows, in frontal plane cross section at the heel portion of a shoe, a shoe sole with naturally contoured sides based on a theoretically ideal stability plane.
Figure 14:
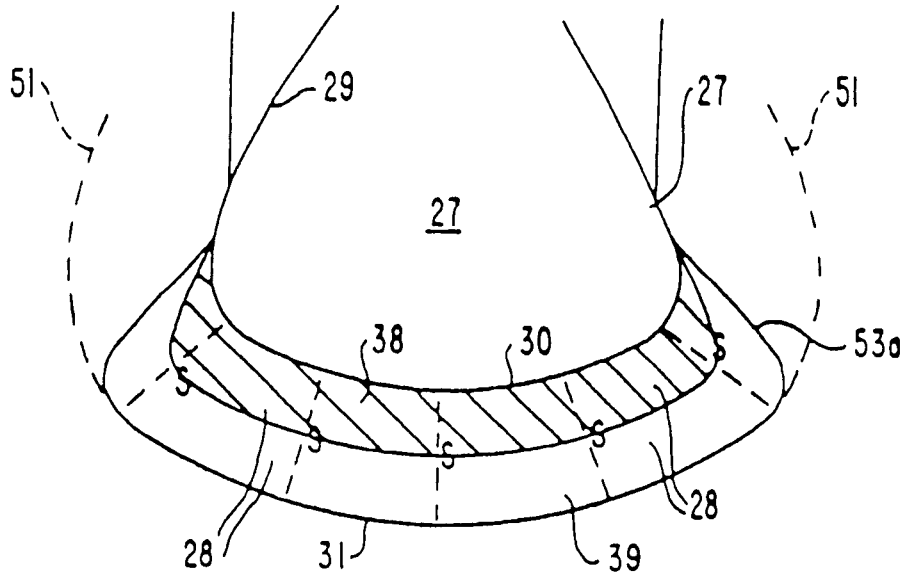
FIG. 14 shows a fully contoured shoe sole that follows the natural contour of the bottom of the foot as well as its sides, also based on the theoretically ideal stability plane.
Figure 15A:
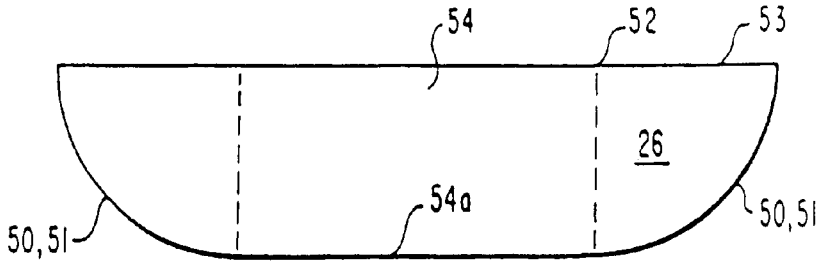
FIGS. 15 A–C, as seen in FIGS. 15A to 15C in frontal plane cross section at the heel, show a quadrant-sided shoe sole, based on a theoretically ideal stability plane.
Figure 15B:
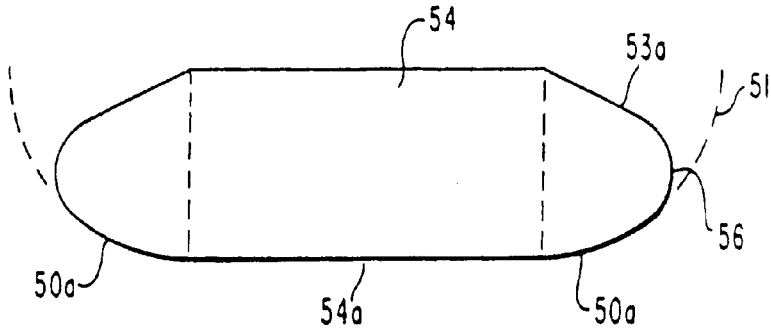
Figure 15C:
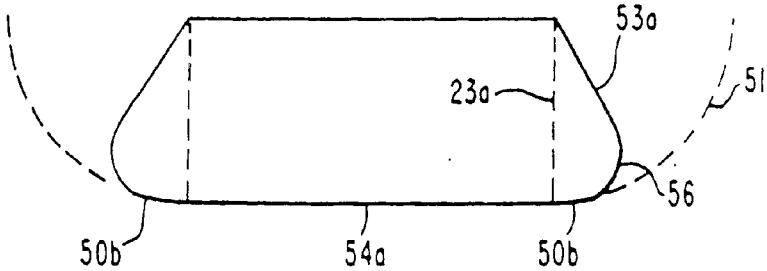

FIGS. 13–15 show frontal plane cross sectional views of a shoe sole according to the applicant's prior inventions based on the theoretically ideal stability plane, taken at about the ankle joint to show the heel section of the shoe. The concept of the theoretically ideal stability plane, as developed in the prior applications as noted, defines the plane 51 in terms of a locus of points determined by the thickness(es) of the sole.

FIG. 13 shows, in a rear cross sectional view, the inner surface of the shoe sole conforming to the natural contour of the foot and the thickness of the shoe sole remaining constant in the frontal plane, so that the outer surface coincides with the theoretically ideal stability plane.

FIG. 14 shows a fully contoured shoe sole design that follows the natural contour of all of the foot, the bottom as well as the sides, while retaining a constant shoe sole thickness in the frontal plane.

FIGS. 13–14 show a heel lift 38 and a combined midsole and outersole 39.

Figure 2:
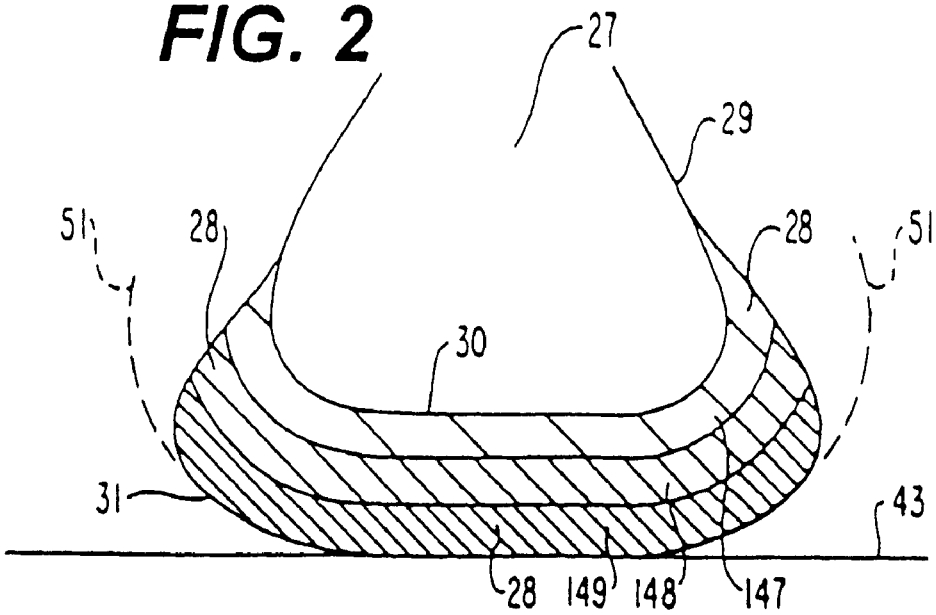

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 2 would deform by flattening to look essentially like FIG. 13. Seen in this light, the naturally contoured side design In FIG. 13 is a more conventional, conservative design that is a special case of the more general fully contoured design in FIG. 14, which is the closest to the natural form of the foot, but the least conventional. The amount of deformation flattening used in the FIG. 13 design, which obviously varies under different loads, is not an essential element of the applicant's invention.

FIGS. 13 and 14 both show in frontal plane cross sections the theoretically ideal stability plane, which is also theoretically ideal for efficient natural motion of all kinds, including running, jogging or walking. FIG. 14 shows the most general case, the fully contoured design, which conforms to the natural shape of the unloaded foot. For any given individual, the theoretically ideal stability plane 51 is determined, first, by the desired shoe sole thickness(es) in a frontal plane cross section, and, second, by the natural shape of the individual's foot surface 29.

For the special case shown in FIG. 13, the theoretically ideal stability plane for any particular individual (or size average of individuals) is determined, first, by the given frontal plane cross section shoe sole thickness(es); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 13, the first part is a line segment 31*b* of equal length and parallel to line 30*b* at a constant distance(s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness(es) from the closest point on the contoured side inner edge 30*a*.

In summary, the theoretically ideal stability plane is used to determine a geometrically precise bottom contour of the shoe sole based on a top contour that conforms to the contour of the foot.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 15 illustrates in frontal plane cross section another variation that uses stabilizing quadrants 26 at the outer edge of a conventional shoe sole 28*b* illustrated generally at the reference numeral 28. The stabilizing quadrants would be abbreviated in actual embodiments.

What is claimed is:

1. An athletic shoe sole for supporting a foot of an intended wearer, the shoe sole comprising:

a sole inner surface;

a sole outer surface;

the sole surfaces of the athletic shoe together defining a sole medial side, a sole lateral side, and a sole middle portion between the sole sides;

the sole comprising a heel portion at a location substantially corresponding to a heel of the intended wearer's foot, a forefoot portion at a location substantially corresponding to a forefoot of the intended wearer's foot, and a third portion at a location between the heel and forefoot portions;

the heel portion having a lateral heel part at a location substantially corresponding to the lateral tuberosity of the calcaneus of the intended wearer's foot, and a medial heel part at a location substantially corresponding to the base of the calcaneus of the intended wearer's foot;

the third portion having a lateral midtarsal part at a location substantially corresponding to the base of a fifth metatarsal of the intended wearer's foot, and a main longitudinal arch part at a location substantially corresponding to the longitudinal arch of the intended wearer's foot;

the forefoot portion having a forward medial forefoot part at a location substantially corresponding to the head of the first distal phalange of the intended wearer's foot, and rear medial and lateral forefoot parts at locations substantially corresponding to the heads of the medial and lateral metatarsals of the intended wearer's foot;

at least three rounded portions, each formed by midsole component, each of said rounded midsole portions being located between a concavely rounded portion of an inner surface of the midsole component and a concavely rounded portion of an outer surface of the midsole component, as viewed in a frontal plane cross-section when the shoe sole is upright and in an unloaded condition, the concavity of the concavely rounded portion of the inner surface of the midsole component existing with respect to an intended wearer's foot location inside the shoe, and the concavity of the concavely rounded portion of the outer surface of the midsole component existing with respect to an inner section of the midsole component located adjacent to the concavely rounded outer surface portion;

each of said rounded midsole portions being located at a different position on the sole, the different positions comprising positions near to at least one of the medial heel part, lateral heel part, forward medial forefoot part, rear medial forefoot part, rear lateral forefoot part, lateral midtarsal part, and main longitudinal arch part;

the concavely rounded portion of the outer surface of each of said rounded midsole portions extends at least to a lowermost point of the midsole component, as viewed in each said frontal plane cross-section when the shoe sole is upright and in an unloaded condition;

an outer sole;

the sole having a lateral sidemost section being located at a location outside of a straight vertical line extending through the shoe sole at a lateral sidemost extent of the inner surface of the midsole component, as viewed in a shoe sole frontal plane cross-section when the shoe sole is upright and in an unloaded condition;

the sole having a medial sidemost section being located at a location outside of a straight vertical line extending through the shoe sole at a medial sidemost extent of the inner surface of the midsole component, as viewed in a shoe sole frontal plane cross-section when the shoe sole is upright and in an unloaded condition;

a midsole part extends into the sidemost section of the sole side at the location of each of said rounded portions, as viewed in a shoe sole frontal plane cross-section when the shoe sole is upright and in an unloaded condition;

each said midsole part further extends to above a level corresponding to a lowest point of the midsole component inner surface of the same sole side, as viewed in a shoe sole frontal plane cross-section when the shoe sole is upright and in an unloaded condition;

at least part of a midsole component in the sole third portion deviates from a straight line between a lowermost part of the midsole component outer surface of the sole heel portion and a lowermost part of the midsole component outer surface of the sole forefoot portion in a manner whereby the outer surface of said part of the midsole component in the sole third portion is above the straight line between the lowermost part of the midsole component outer surface of the sole heel portion and the lowermost part of the midsole component outer surface of the sole forefoot portion, as viewed in a shoe sole sagittal plane cross-section when the shoe sole is upright and in an unloaded condition;

at least part of the outer surface of the midsole component forms a portion of the outer surface of the shoe sole; and said shoe sole has a heel portion thickness that is greater than a forefoot portion thickness, as viewed in a shoe sole sagittal plane cross-section when the shoe sole is upright and in an unloaded condition.

2. The shoe sole of claim 1, wherein the part of the midsole component outer surface of the sole third portion that deviates from a straight line is substantially convexly rounded, as viewed in a shoe sole sagittal plane cross-section when the shoe sole is upright and in an unloaded condition, the convexity existing with respect to an inner section of the midsole component located adjacent to the convexly rounded outer surface portion.

3. The shoe sole of claim 1, wherein the shoe sole comprises at least four said rounded midsole portions.

4. The shoe sole of claim 1, wherein the shoe sole comprises at least five said rounded midsole portions.

5. The shoe sole of claim 1, wherein the shoe sole comprises at least six said rounded midsole portions.

6. The shoe sole of claim 1, wherein the shoe sole comprises at least seven said rounded midsole portions.

7. The shoe sole of claim 1, wherein one said rounded midsole portion is located at the lateral midtarsal part, another said rounded midsole portion is located at the rear lateral forefoot part, and the sole having a part that deviates from a straight line between a lowermost part of the sole outer surface of the sole heel portion and a lowermost part of the sole outer surface of the sole forefoot portion, in a manner whereby the outer surface of said part of the shoe sole is above the straight line between the lowermost part of the outer surface of the shoe sole in the sole heel portion and the lowermost part of the sole outer surface of the shoe sole in the sole forefoot portion, and said part that deviates from a straight line is located between the lateral midtarsal part and rear lateral forefoot part rounded midsole portions for forming a first flexibility axis in the sole, as viewed in a shoe sole horizontal plane when the shoe sole is upright and in an unloaded condition.

8. The shoe sole of claim 1, wherein one said rounded midsole portion is located at the lateral heel part, another said rounded midsole portion is located at the lateral midtarsal part, and the sole having a part that deviates from a straight line between a lowermost part of the sole outer surface of the sole heel portion and a lowermost part of the sole outer surface of the sole forefoot portion, in a manner whereby the outer surface of said part of the shoe sole is above the straight line between the lowermost part of the outer surface of the shoe sole in the sole heel portion and the lowermost part of the sole outer surface of the shoe sole in the sole forefoot portion, and said part that deviates from a straight line is located between said rounded midsole portions for forming a flexibility axis in the sole, as viewed in a shoe sole horizontal plane when the shoe sole is upright and in an unloaded condition.

9. A shoe sole according to claim 1, wherein one said rounded midsole portion is located at the lateral midtarsal part.

10. The shoe sole of claim 1, wherein the outer sole is positioned such that at least a portion of said outer sole is located in each frontal plane cross-section which contains a rounded midsole portion.

11. The shoe sole of claim 1, wherein a thickness between the inner surface of the midsole component and the outer surface of the midsole component increases gradually from a thickness at an uppermost point of each of said midsole parts to a lesser thickness at a location below the uppermost point of each of said midsole parts, said thickness being defined as the distance between a first point on the inner surface of the midsole component and a second point on the outer surface of the midsole component, said second point being located along a straight line perpendicular to a straight line tangent to the inner surface of the midsole component at said first point, all as viewed in a frontal plane cross-section when the shoe sole is upright and in an unloaded condition.

12. A shoe sole as claimed in claim 1, wherein the portion of the outer surface of the shoe sole formed by midsole is located in a sidemost section of a shoe sole side.

13. The shoe sole of claim 1, wherein the shoe sole further comprises a part, adjacent to one said rounded midsole portion, that deviates from a straight line between a lowermost part of the sole outer surface of the sole heel portion and a lowermost part of the sole outer surface of the sole forefoot portion, in a manner whereby the outer surface of said part of the shoe sole that deviates from a straight line is above the straight line between the lowermost part of the outer surface of the shoe sole in the sole heel portion and the lowermost part of the sole outer surface of the shoe sole in the sole forefoot portion, as viewed in a shoe sole horizontal plane when the shoe sole is upright and in an unloaded condition.

14. The shoe sole of claim 13, wherein the part of the shoe sole that deviates from a straight line is located anterior to one said rounded midsole portion and the shoe sole includes a second part that deviates from a straight line between a lowermost part of the sole outer surface of the sole heel portion and a lowermost part of the sole outer surface of the sole forefoot portion, in a manner whereby the outer surface of said part of the shoe sole that deviates from a straight line is above the straight line between the lowermost part of the outer surface of the shoe sole in the sole heel portion and the lowermost part of the sole outer surface of the shoe sole in the sole forefoot portion, and said second part that deviates from a straight line is located posterior to one said rounded midsole portion, all as viewed in a shoe sole horizontal plane when the shoe sole is upright and in an unloaded condition.

15. The shoe sole of claim 1, wherein one said rounded midsole portion is located at the heel portion of the shoe sole, and the shoe sole further comprises a first part that deviates from a straight line between a lowermost part of the sole outer surface of the sole heel portion and a lowermost part of the sole outer surface of the sole forefoot portion, in a manner whereby the outer surface of said first part of the shoe sole that deviates from a straight line is above the straight line between the lowermost part of the outer surface of the shoe sole in the sole heel portion and the lowermost part of the sole outer surface of the shoe sole in the sole forefoot portion, said first part that deviates from a straight line being located on a lateral side of the shoe sole anterior to the rounded midsole portion located at the heel portion, and a second part that deviates from a straight line between a lowermost part of the sole outer surface of the sole heel portion and a lowermost part of the sole outer surface of the sole forefoot portion, in a manner whereby the outer surface of said second part of the shoe sole that deviates from a straight line is above the straight line between the lowermost part of the outer surface of the shoe sole in the sole heel portion and the lowermost part of the sole outer surface of the shoe sole in the sole forefoot portion, said second part that deviates from a straight line being located on a medial side of the shoe sole anterior to the rounded midsole portion located at the heel portion, all as viewed in a shoe sole horizontal plane when the shoe sole is upright and in an unloaded condition.

16. The shoe sole of claim 1, further comprising at least three tapered portions each having a thickness that decreases gradually from a first thickness to a lesser thickness, as viewed in a shoe sole horizontal plane when the shoe sole is upright and in an unloaded condition, said thickness of each of said tapered portions being measured from the inner surface of the midsole component to the outer surface of the shoe sole, and each of said tapered portions being located at a location on the shoe sole corresponding to a location of each of the rounded midsole portions.

17. The shoe sole of claim 16, wherein each said concavely rounded portion of the midsole component inner surface extends to an inner surface sidemost extent of said midsole component, as viewed in a shoe sole frontal plane cross-section when the shoe sole is unloaded and in an upright condition.

18. The shoe sole of claim 16, wherein each said concavely rounded portion of the midsole component outer surface extends from the sole middle portion to an outer surface sidemost extent of said midsole component, as viewed in a shoe sole frontal plane cross-section when the shoe sole is unloaded and in an upright condition.

19. The shoe sole of claim 16, wherein each said concavely rounded portion of the midsole component outer surface extends from a location on the midsole component outer surface at about the height of a lowest point of the midsole component inner surface at least to a lowermost point of the outer surface of the midsole component, as viewed in a shoe sole frontal plane cross-section when the shoe sole is unloaded and in an upright condition.

20. The shoe sole of claim 16, wherein each said concavely rounded portion of the midsole component outer surface extends from a location on the midsole component outer surface that is above the height of a lowest point of the midsole component inner surface at least to a lowermost point of the outer surface of the midsole component, as viewed in a shoe sole frontal plane cross-section when the shoe sole is unloaded and in an upright condition.

21. The shoe sole of claim 16, wherein each said concavely rounded portion of the midsole component outer surface extends to a sidemost extent of the midsole component, as viewed in a shoe sole frontal plane cross-section when the shoe sole is unloaded and in an upright condition.

22. The shoe sole of claim 16, wherein the thickness of each said tapered portion tapers to zero, as viewed in a horizontal plane when the shoe sole is upright and in an unloaded condition.

23. The shoe sole of claim 16, wherein at least part of the outer surface of each of said tapered portions is formed by midsole component and is concavely rounded, as viewed in the shoe sole horizontal plane when the shoe sole is upright and in an unloaded condition, the concavity existing with respect to an inner section of midsole component located adjacent to the concavely rounded outer surface of the tapered portion formed by midsole component.

24. The shoe sole of claim 23, wherein the shoe sole comprises at least four said rounded midsole portions.

25. The shoe sole of claim 23, wherein the shoe sole comprises at least five said rounded midsole portions.

26. The shoe sole of claim 23, wherein the shoe sole comprises at least six said rounded midsole portions.

27. The shoe sole of claim 23, wherein the shoe sole comprises at least seven said rounded midsole portions.

28. The shoe sole of claim 23, wherein each said at least one rounded midsole portion encompasses substantially all of its respective part.

29. The shoe sole of claim 28, wherein each said rounded midsole portion encompasses substantially only said respective part.

30. The shoe sole of claim 23, wherein one said rounded midsole portion is located at the lateral midtarsal part.

31. The shoe sole of claim 23, wherein one said rounded midsole portion is located at the main longitudinal arch part.

32. The shoe sole of claim 23, wherein one said rounded midsole portion is located at the medial heel part.

33. The shoe sole of claim 23, wherein one said rounded midsole portion is located at the rear medial forefoot part.

34. The shoe sole of claim 23, wherein one said rounded midsole portion is located at the rear lateral forefoot part.

35. The shoe sole of claim 23, wherein one said rounded midsole portion is located at the lateral heel part.

36. The shoe sole of claim 23, wherein one said rounded midsole portion is located at the forward medial forefoot part.

37. The shoe sole of claim 23, wherein one said rounded midsole portion is located at the rear medial forefoot part and another said rounded midsole portion is located at the rear lateral forefoot part, the sole forming a groove between said rounded midsole portions, as viewed in a shoe sole frontal plane cross-section when the shoe sole is upright and in an unloaded condition.

38. The shoe sole of claim 23, wherein the shoe sole further comprises, at the location of each said rounded midsole portion, a second tapered portion having a thickness that decreases gradually from a first thickness to a lesser thickness, as viewed in a shoe sole horizontal plane when the shoe sole is upright and in an unloaded condition.

39. The shoe sole of claim 38, wherein at least part of the outer surface of each said second tapered portion is formed by midsole component and is concavely rounded, the concavity being determined relative to an inner section of the midsole component adjacent to the concavely rounded outer surface portion of each said second tapered portion, as viewed in a shoe sole horizontal plane when the shoe sole is upright and in an unloaded condition.

40. The shoe sole of claim 38, wherein the thickness of each said tapered portion tapers to zero, as viewed in a horizontal plane when the shoe sole is upright and in an unloaded condition.

41. The shoe sole of claim 40, wherein the thickness of each said second tapered portion tapers to zero, as viewed in a horizontal plane when the shoe sole is upright and in an unloaded condition.

42. A shoe sole as claimed in claim 1, wherein at least a portion of at least one of said rounded portions of the midsole component has a substantially uniform thickness extending through an arc of at least 20 degrees, as viewed in a frontal plane cross-section when the shoe sole is upright and in an unloaded condition.

43. A shoe sole as claimed in claim 42, wherein at least two of said rounded portions has a substantially uniform thickness extending through an arc of at least 20 degrees, as viewed in a frontal plane cross-section when the shoe sole is upright and in an unloaded condition.

44. A shoe sole as claimed in claim 43, wherein at least three of said rounded portions has a substantially uniform thickness extending through an arc of at least 20 degrees, as viewed in a frontal plane cross-section when the shoe sole is upright and in an unloaded condition.

45. A shoe sole as claimed in claim 43, wherein the substantially uniform thickness of the shoe sole, as viewed in a frontal plane cross-section, is different when measured in at least two separate frontal plane cross-sections.

46. A shoe sole as claimed in claim 1, wherein at least a portion of at least one of said rounded portions of the midsole component has a substantially uniform thickness extending substantially to a sidemost extent of the a side of the midsole component, as viewed in a frontal plane cross-section when the shoe sole is upright and in an unloaded condition.

47. A shoe sole as claimed in claim 46, wherein at least two of said rounded portions has a substantially uniform thickness extending substantially to a sidemost extent of a side of the midsole component, as viewed in a frontal plane cross-section when the shoe sole is upright and in an unloaded condition.

48. A shoe sole as claimed in claim 47, wherein at least three of said rounded portions has a substantially uniform thickness extending substantially to a sidemost extent of a side of the midsole component, as viewed in a frontal plane cross-section when the shoe sole is upright and in an unloaded condition.

49. A shoe sole as claimed in claim 47, wherein the substantially uniform thickness of the shoe sole, as viewed in a frontal plane cross-section, is different when measured in at least two separate frontal plane cross-sections.

* * * * *